US007878729B2

(12) United States Patent
Cheng

(10) Patent No.: US 7,878,729 B2
(45) Date of Patent: Feb. 1, 2011

(54) INTERMEDIATE CONNECTOR FOR A RING BINDER MECHANISM

(75) Inventor: Hung Yu Cheng, Hong Kong (CN)

(73) Assignee: World Wide Stationery Manufacturing Company, Ltd., Hong Kong (CN)

( * ) Notice: Subject to any disclaimer, the term of this patent is extended or adjusted under 35 U.S.C. 154(b) by 701 days.

(21) Appl. No.: 11/140,728

(22) Filed: May 31, 2005

(65) Prior Publication Data

US 2005/0232689 A1 Oct. 20, 2005

Related U.S. Application Data

(63) Continuation of application No. 10/323,052, filed on Dec. 18, 2002, now Pat. No. 7,296,946, which is a continuation-in-part of application No. 09/683,205, filed on Nov. 30, 2001, now Pat. No. 6,749,357.

(51) Int. Cl.

| | |
|---|---|
| ***B42F 13/20*** | (2006.01) |
| ***B42F 3/04*** | (2006.01) |
| ***B42F 3/00*** | (2006.01) |
| ***B42F 13/12*** | (2006.01) |
| ***B42F 13/00*** | (2006.01) |

(52) U.S. Cl. ..... 402/38; 402/31; 402/36; 402/41; 402/70; 402/73; 402/75

(58) Field of Classification Search ..... 24/381; 402/19, 26, 31, 36, 37, 38, 39, 40, 41, 42, 402/70, 73, 75

See application file for complete search history.

(56) References Cited

U.S. PATENT DOCUMENTS 566,717 A 8/1896 Krah (Continued)

FOREIGN PATENT DOCUMENTS

DE 10119121 A1 10/2001

(Continued)

OTHER PUBLICATIONS

Kokuyo Lock Ring Mechanism with description, two instruction sheets, and nine photographs, undated but admitted as prior art.

(Continued)

*Primary Examiner*—Dana Ross
*Assistant Examiner*—Justin V Lewis
(74) *Attorney, Agent, or Firm*—Senniger Powers LLP

(57) ABSTRACT

A ring binder mechanism for retaining loose-leaf pages includes an elongate plate supporting two hinge plates for pivoting movement relative to the elongate plate. Ring members move with the pivoting movement of the hinge plates between a closed position for retaining loose-leaf pages on the mechanism and an open position for adding or removing pages from the mechanism. An actuating lever is mounted on the elongate plate for moving the ring members between their closed and open positions and for moving a travel bar in translation lengthwise of the elongate plate. A connector connects the lever to the travel bar so that the pivoting movement of the lever causes the translational movement of the travel bar. The connector is shaped to transfer force from the lever to the travel bar around a mounting post.

15 Claims, 23 Drawing Sheets

U.S. PATENT DOCUMENTS

| | | | | | |
|---|---|---|---|---|---|
| 651,254 | A | | 6/1900 | Krah | |
| 683,019 | A | | 9/1901 | Buchanan | |
| 790,382 | A | | 5/1905 | McBride | |
| 854,074 | A | | 5/1907 | Bryant | |
| 857,377 | A | | 6/1907 | Baker | |
| 974,831 | A | | 11/1910 | Scherzinger | |
| 1,011,391 | A | | 12/1911 | Sturgis | |
| 1,163,179 | A | | 12/1915 | Schade | |
| 1,168,260 | A | | 1/1916 | Albrecht | |
| 1,398,034 | A | | 11/1921 | Mero | |
| 1,398,388 | A | | 11/1921 | Murphy | |
| 1,733,548 | A | | 10/1929 | Martin | |
| 1,733,894 | A | | 10/1929 | Martin | |
| 1,787,957 | A | | 1/1931 | Schade | |
| 1,822,669 | A | | 9/1931 | Schade | |
| 1,857,291 | A | | 5/1932 | Trussell | |
| 1,896,839 | A | * | 2/1933 | Dawson | 402/38 |
| 1,953,981 | A | | 4/1934 | Trussell | |
| 1,991,362 | A | | 2/1935 | Krag | |
| 1,996,463 | A | | 4/1935 | Dawson | |
| 2,004,570 | A | | 6/1935 | Dawson | |
| 2,013,416 | A | | 9/1935 | McClure | |
| 2,024,461 | A | | 12/1935 | Lotter | |
| 2,067,846 | A | | 1/1937 | Cooper | |
| 2,075,766 | A | | 3/1937 | Rand | |
| 2,089,211 | A | | 8/1937 | Krag | |
| 2,096,944 | A | | 10/1937 | Unger | |
| 2,103,307 | A | | 12/1937 | Unger | |
| 2,105,235 | A | | 1/1938 | Schade | |
| 2,158,056 | A | | 5/1939 | Cruzan | |
| 2,179,627 | A | | 11/1939 | Handler | |
| 2,204,918 | A | | 6/1940 | Trussell | |
| 2,218,105 | A | | 10/1940 | Griffin | |
| 2,236,321 | A | | 3/1941 | Ostrander | |
| 2,239,062 | A | | 4/1941 | Tallmadge | |
| 2,239,121 | A | | 4/1941 | St. Louis | |
| 2,251,878 | A | | 8/1941 | Hanna | |
| 2,252,422 | A | | 8/1941 | Unger | |
| 2,260,929 | A | | 10/1941 | Bloore | |
| 2,288,189 | A | | 6/1942 | Guinane | |
| 2,304,716 | A | | 12/1942 | Supin | |
| 2,311,492 | A | | 2/1943 | Unger | |
| 2,322,595 | A | | 6/1943 | Schade | |
| 2,338,011 | A | | 12/1943 | Schade | |
| 2,421,799 | A | | 6/1947 | Martin | |
| 2,528,866 | A | | 11/1950 | Dawson | |
| 2,543,866 | A | * | 3/1951 | Panfil, Sr. | 402/26 |
| 2,552,076 | A | | 5/1951 | Wedge | |
| 2,612,169 | A | | 9/1952 | Segal | |
| 2,789,561 | A | | 4/1957 | Bonn | |
| 2,865,377 | A | | 12/1958 | Schroer | |
| 2,871,711 | A | | 2/1959 | Stark | |
| 2,891,553 | A | | 6/1959 | Acton | |
| 2,894,513 | A | | 7/1959 | Gempe | |
| 3,077,888 | A | | 2/1963 | Thieme | |
| 3,098,489 | A | | 7/1963 | Vernon | |
| 3,098,490 | A | | 7/1963 | Wance | |
| 3,104,667 | A | | 9/1963 | Mintz | |
| 3,149,636 | A | | 9/1964 | Rankin | |
| 3,190,293 | A | | 6/1965 | Schneider | |
| 3,205,894 | A | | 9/1965 | Rankin | |
| 3,205,895 | A | | 9/1965 | Johnson | |
| 3,255,759 | A | | 6/1966 | Dennis | |
| 3,348,550 | A | | 10/1967 | Wolf | |
| 3,718,402 | A | | 2/1973 | Schade | |
| 3,748,051 | A | | 7/1973 | Frank | |
| 3,884,586 | A | | 5/1975 | Michaelis et al. | |
| 3,954,343 | A | | 5/1976 | Thomsen | |
| 3,993,374 | A | * | 11/1976 | Schudy et al. | 402/38 |
| 4,127,340 | A | | 11/1978 | Almgren | |
| 4,130,368 | A | | 12/1978 | Jacoby et al. | |
| 4,352,582 | A | | 10/1982 | Eliasson | |
| 4,486,112 | A | | 12/1984 | Cummins | |
| 4,522,526 | A | | 6/1985 | Lozfau | |
| 4,566,817 | A | | 1/1986 | Barrett, Jr. | |
| 4,571,108 | A | | 2/1986 | Vogl | |
| 4,696,595 | A | | 9/1987 | Pinkney | |
| 4,798,491 | A | | 1/1989 | Lassle | |
| 4,813,803 | A | | 3/1989 | Gross | |
| 4,815,882 | A | | 3/1989 | Ohminato | |
| 4,886,390 | A | | 12/1989 | Silence | |
| 4,919,557 | A | | 4/1990 | Podosek | |
| 5,116,157 | A | | 5/1992 | Gillum et al. | |
| 5,180,247 | A | | 1/1993 | Yu | |
| 5,255,991 | A | | 10/1993 | Sparkes | |
| 5,286,128 | A | | 2/1994 | Gillum | |
| 5,332,327 | A | | 7/1994 | Gillum | |
| 5,346,325 | A | | 9/1994 | Yamanoi | |
| 5,354,142 | A | | 10/1994 | Yu | |
| 5,368,407 | A | | 11/1994 | Law | |
| 5,378,073 | A | | 1/1995 | Law | |
| 5,393,155 | A | | 2/1995 | Ng | |
| 5,393,156 | A | | 2/1995 | Mullin | |
| 5,476,335 | A | | 12/1995 | Whaley | |
| 5,524,997 | A | | 6/1996 | von Rohrscheidt | |
| 5,577,852 | A | * | 11/1996 | To | 402/31 |
| 5,634,666 | A | | 6/1997 | Lee | |
| 5,651,628 | A | | 7/1997 | Bankes et al. | |
| 5,660,490 | A | | 8/1997 | Warrington | |
| 5,662,386 | A | * | 9/1997 | Newman et al. | 299/37.5 |
| 5,692,847 | A | | 12/1997 | Zane | |
| 5,692,848 | A | | 12/1997 | Wada | |
| 5,718,529 | A | | 2/1998 | Chan | |
| 5,782,569 | A | | 7/1998 | Mullin | |
| 5,788,392 | A | | 8/1998 | Cheung | |
| 5,807,006 | A | | 9/1998 | Cheung | |
| 5,810,499 | A | | 9/1998 | Law | |
| 5,816,729 | A | | 10/1998 | Whaley | |
| 5,836,709 | A | * | 11/1998 | Cheung | 402/38 |
| 5,868,513 | A | | 2/1999 | Law | |
| 5,879,097 | A | | 3/1999 | Cheng | |
| 5,882,135 | A | * | 3/1999 | Ko | 402/36 |
| 5,895,164 | A | | 4/1999 | Wu | |
| 5,924,811 | A | * | 7/1999 | To et al. | 402/26 |
| 5,957,611 | A | | 9/1999 | Whaley | |
| 5,975,785 | A | | 11/1999 | Chan | |
| 6,036,394 | A | * | 3/2000 | Cheng | 402/26 |
| 6,142,697 | A | | 11/2000 | Williams | |
| 6,146,042 | A | | 11/2000 | To | |
| 6,155,737 | A | | 12/2000 | Whaley | |
| 6,203,229 | B1 | | 3/2001 | Coerver | |
| 6,206,601 | B1 | | 3/2001 | Ko | |
| 6,217,247 | B1 | | 4/2001 | Ng | |
| 6,270,279 | B1 | | 8/2001 | Whaley | |
| 6,276,862 | B1 | * | 8/2001 | Snyder et al. | 402/40 |
| 6,293,722 | B1 | | 9/2001 | Holbrook et al. | |
| 6,364,558 | B1 | | 4/2002 | To | |
| 6,371,678 | B1 | | 4/2002 | Chizmar | |
| 6,467,984 | B1 | | 10/2002 | To | |
| 6,474,897 | B1 | | 11/2002 | To | |
| 6,533,486 | B1 | | 3/2003 | To | |
| 6,749,357 | B2 | * | 6/2004 | Cheng | 402/19 |
| 6,758,621 | B2 | | 7/2004 | To | |
| 6,821,045 | B2 | | 11/2004 | Whaley | |
| 6,916,134 | B2 | | 7/2005 | Wong | |
| 7,296,946 | B2 | | 11/2007 | Cheng | |
| 2002/0122687 | A1 | | 9/2002 | Horn | |
| 2003/0044221 | A1 | | 3/2003 | To | |
| 2003/0103797 | A1 | | 6/2003 | Cheng | |
| 2003/0103798 | A1 | * | 6/2003 | Cheng et al. | 402/73 |
| 2003/0123923 | A1 | | 7/2003 | Koike | |
| 2005/0013654 | A1 | | 1/2005 | Cheng | |
| 2005/0201817 | A1 | | 9/2005 | Cheng | |
| 2005/0201818 | A1 | | 9/2005 | Cheng | |

| | | | | |
|---|---|---|---|---|
| 2005/0201819 | A1 | 9/2005 | Cheng | |
| 2005/0201820 | A1 | 9/2005 | Ng | |
| 2005/0207826 | A1 | 9/2005 | Cheng | |
| 2005/0214064 | A1 | 9/2005 | Ng | |
| 2005/0232689 | A1 | 10/2005 | Cheng | |
| 2006/0008318 | A1 | 1/2006 | Ng | |
| 2006/0056906 | A1 | 3/2006 | Horn | |
| 2006/0147253 | A1 | 7/2006 | Cheng | |
| 2006/0147254 | A1 | 7/2006 | Cheng | |
| 2006/0147255 | A1 | 7/2006 | Cheng | |
| 2006/0153628 | A1 | 7/2006 | Tanaka | |
| 2006/0153629 | A1 | 7/2006 | Cheng | |
| 2006/0216107 | A1 | 9/2006 | Lin | |
| 2006/0228164 | A1 | 10/2006 | Horn | |
| 2006/0251467 | A1 | 11/2006 | Cheng | |
| 2006/0251468 | A1 | 11/2006 | Cheng | |
| 2007/0086836 | A1 | 4/2007 | Cheng | |
| 2008/0075527 | A1 * | 3/2008 | Pi et al. | 402/41 |
| 2009/0041532 | A1 * | 2/2009 | Cheng et al. | 402/38 |

FOREIGN PATENT DOCUMENTS

| | | | |
|---|---|---|---|
| EP | 1 316 438 | A1 | 6/2003 |
| EP | 1323545 | A2 | 7/2003 |
| EP | 1431065 | A2 | 6/2004 |
| FR | 1 336 765 | | 7/1962 |
| FR | 1336765 | | 9/1963 |
| FR | 1 346 864 | A | 12/1963 |
| FR | 1346864 | | 12/1963 |
| FR | 2221924 | | 10/1974 |
| FR | 2 238 332 | A | 2/1975 |
| FR | 2238332 | | 2/1975 |
| GB | 868724 | | 5/1961 |
| GB | 906279 | | 9/1962 |
| GB | 952536 | | 3/1964 |
| GB | 2231536 | A | 11/1990 |
| GB | 2251215 | A | 7/1992 |
| GB | 2275023 | A | 8/1994 |
| GB | 2 292 343 | A | 2/1996 |
| GB | 2 387 815 | A | 10/2003 |
| JP | 5979379 | | 5/1984 |
| JP | 6118880 | | 2/1986 |
| JP | 1299095 | A | 12/1989 |
| JP | 2-34289 | U | 3/1990 |
| JP | 4120085 | | 10/1992 |
| JP | 10217662 | | 8/1998 |
| JP | 2004098417 | A | 4/2004 |
| WO | 0119620 | A1 | 3/2001 |
| WO | WO 01/19620 | A1 | 3/2001 |
| WO | WO 01/81099 | A1 | 11/2001 |

OTHER PUBLICATIONS

European Search Report for EP 02 25 8198 dated Feb. 27, 2003, 2 pages.

Kokuyo Lock Ring Mechanism with description, two instruction sheets, and nine photographs, undated but admitted as prior art, 12 pgs.

Apr. 20, 2007 Office Action and references in related U.S. Appl. No. 10/323,052, 13 pages.

May 31, 2005 Office Action and references in related U.S. Appl. No. 10/323,052, 11 pages.

Mar. 21. 2005 Office Action in related U.S. Appl. No. 10/323,052, 7 pages.

Sep. 30, 2004 Office Action and references in related U.S. Appl. No. 10/323,052, 8 pages.

Nov. 23, 2007 Office Action and references in related U.S. Appl. No. 10/870,801, 12 pages.

EPO Search Report for EP 05 011 914.8 dated Dec. 27, 2007, 4 pages.

Office Action dated Nov. 23, 2007 from related U.S. Appl. No. 10/870,801, 12 pgs.

Office Action dated Apr. 20, 2007 from related U.S. Appl. No. 10/323,052, 13 pgs.

Office Action dated May 31, 2005 from related U.S. Appl. No. 10/323,052, 11 pgs.

Office Action dated Mar. 21, 2005 from related U.S. Appl. No. 10/323,052, 7 pgs.

Office Action dated Sep. 30, 2004 from related U.S. Appl. No. 10/323,052, 8 pgs.

Response filed Jan. 28, 2008 to Office Action dated Nov. 23, 2008 from U.S. Appl. No. 10/870,801, 10 pgs.

Office Action dated Jun. 13, 2008 from related U.S. Appl. No. 10/870,801, 10 pgs.

Response filed Sep. 9, 2008 to Office Action dated Jun. 13, 2008 from related U.S. Appl. No. 10/870,801, 10 pgs.

Response filed Jul. 3, 2007 to the Office action dated Apr. 20, 2007 from related U.S. Appl. No. 10/323,052, 15 pgs.

Office action dated Mar. 23, 2009 from related U.S. Appl. No. 11/954,990, 11 pgs.

Office action dated Jun. 24, 2009 from related U.S. Appl. No. 12/256,229, 10 pgs.

"Joint Memorandum in Support of Motion for Claim Construction By The Court Regarding U.S. Patent No. 7,404,685" from litigation concerning related U.S. Patent 7,404,685, 517 pages.

"Defendant U.S. Ring Binder, L.P.'s Response to Plaintiff's Proposed Claim Constructions Regarding U.S. Patent No. 7,404,685" from litigation concerning related U.S. Patent 7,404,685, 26 pages.

"Plaintiff World Wide Stationery Manufacturing Co. Ltd.'s Response to Defendant's Proposed Claim Construction of U.S. Patent No. 7,404,685" from litigation concerning related U.S. Patent 7,404,685, 123 pages.

"Markman Hearing Transcript" [transcript of "Markman Hearing"] from litigation concerning related U.S. Patent 7,404,685, 148 pages.

"Plaintiff's Post-Hearing Claim Construction Brief" from litigation concerning related U.S. Patent 7,404,685, 640 pages.

"Defendant U.S. Ring Binder, L.P.'s Supplemental Brief Regarding Claim Construction" from litigation concerning related U.S. Patent 7,404,685, 177 pages.

"List of Disputed and Non-Disputed Claim Terms" from litigation concerning related U.S. Patent 7,404,685, 3 pages.

"Opening Expert Report of Dr. Virgil J. Flanigan" from litigation concerning related U.S. Patent 7,404,685, 175 pages.

"Expert Witness Report of Jeffrey K. Ball, Ph.D., P.E." from litigation concerning related U.S. Patent 7,404,685, 166 pages.

"Defendant U.S. Ring Binder LP's Motion, Statement of Undisputed Material Facts, and Memorandum in Support of Motion for Summary Judgment of Non-Infringement of U.S. Patent No. 7,296,946" from litigation concerning related U.S. Patent 7,404,685, 95 pages.

"Memorandum And Order" from litigation concerning related U.S. Patent 7,404,685, 39 pages.

"Supplemental Report Of Jeffrey K. Ball, Ph.D., P.E." from litigation concerning related U.S. Patent 7,404,685, 7 pages.

"Expert Witness Report of Jeffrey K. Ball, Ph.D., P.E." from litigation concerning related U.S. Patent 7,404,685, 53 pages.

"Defendant's Supplemental Motion for Summary Judgment of Non-Infringment of U.S. Patent No. 7,296,946 and U.S. Patent No. 7,404,685" from litigation concerning related U.S. Patent 7,404,685, 176 pages.

"Statement of Uncontroverted Material Facts in Support of Plaintiff's Motion for Partial Summary Judgment on the Issue of Infringement of U.S. Patent No. 7,404,685" from litigation concerning related U.S. Patent 7,404,685, 126 pages.

"Motion for Summary Judgment of Non-Infringement of U.S. Patent No. 7,296,946 and Motion for Summary Judgment of Invalidity of U.S. Patent No. 7,296,946 Based on Improper Inventorship" from litigation concerning related U.S. Patent 7,404,685, 2 pages.

"Plaintiff's Motion for Partial Summary Judgment on the Issue of Infringement of U.S. Patent No. 7,404,685" from litigation concerning related U.S. Patent 7,404,685, 3 pages.

"Memorandum in Support of Plaintiff's Motion for Partial Summary Judgment on the Issue of Infringement of U.S. Patent No. 7,404,685" from litigation concerning related U.S. Patent 7,404,685, 14 pages.

"Plaintiff's Response to Defendant's Statement of Undisputed Material Facts in Support of Motion for Summary Judgment of Non- Infringement of U.S. Patent No. 7,296,946 and Plaintiff's Statement of Additional Material Facts" from litigation concerning related U.S. Patent 7,404,685, 9 pages.
"Supplemental Report Of Jeffrey K. Ball, Ph.D., P.E." from litigation concerning related U.S. Patent 7,404,685, 6 pages.
"Memorandum in Opposition to Plaintiff's Motion for Partial Summary Judgment on the Issue of Infringement of U.S. Patent No. 7,404,685" from litigation concerning related U.S. Patent 7,404,685, 18 pages.
"Plaintiff's Response in Opposition to Defendant's Motion for Summary Judgment of Non-Infringement of U.S. Patent No. 7,296,946" from litigation concerning related U.S. Patent 7,404,685, 5 pages.
"Supplemental Expert Report of Dr. Virgil J. Flanigan" from litigation concerning related U.S. Patent 7,404,685, 19 pages.
"U.S. Ring Binder LP's Reply Brief in Support of Its Motions for Summary Judgment of Non-Infringement of U.S. Patent No. 7,296,946 and U.S. Patent No. 7,404,685" from litigation concerning related U.S. Patent 7,404,685, 4 pages.
"Reply Memorandum in Support of Plaintiff's Motion for Partial Summary Judgment on the Issue of Infringement of U.S. Patent No. 7,404,685" from litigation concerning related U.S. Patent 7,404,685, 10 pages.
"Rebuttal Report of Dr. Virgil J. Flanigan in Response to the Expert Report, Declaration and Supplemental Report of Jeffrey K. Ball" from litigation concerning related U.S. Patent 7,404,685, 10 pages.
"Memorandum in Support of Plaintiff's Motion for Reconsideration of the Court's Claim Construction Ruling" from litigation concerning related U.S. Patent 7,404,685, 16 pages.
"Amended Memorandum and Order" from litigation concerning related U.S. Patent 7,404,685, 33 pages.
"Expert Witness Report on Invalidity of Jeffrey K. Ball, Ph.D., P.E." from *U.S. Ring Binder, L.P.* v. *Staples The Office Superstore LLC, et al.*, 39 pages.
Response filed Jul. 23, 2009 to Office action dated Mar. 23, 2009 in related U.S. Appl. No. 11/954,990, 11 pages.
Response filed Oct. 26, 2009 to Office action dated Jun. 24, 2009 in related U.S. Appl. No. 12/256,229, 13 pages.
Office action issued Nov. 23, 2009 in related U.S. Appl. No. 11/954,990, 11 pgs.
Office action issued Nov. 23, 2009 in related U.S. Appl. No. 12/256,229, 13 pgs.

* cited by examiner

INTERMEDIATE CONNECTOR FOR A RING BINDER MECHANISM

CROSS-REFERENCE TO RELATED APPLICATION

This application is a continuation application of U.S. patent application Ser. No. 10/323,052, filed Dec. 18, 2002, which is a continuation-in-part application of U.S. patent application Ser. No. 09/683,205, filed Nov. 30, 2001, now U.S. Pat. No. 6,749,357, the entire disclosures of which are hereby incorporated by reference.

BACKGROUND OF THE INVENTION

This invention relates to binders for holding loose leaf pages, and in particular to an improved mechanism for opening and closing binders.

A ring binder retains loose leaf pages, such as hole-punched papers, in a file or notebook. It features ring members for retaining the papers which may be selectively opened to add or remove papers, or closed to retain papers while allowing them to be moved along the ring members. Levers are typically provided on both ends of the binder for moving the ring members between the open and closed positions.

One drawback to ring binders of the prior art is that when ring members are being closed, they snap shut with a strong magnitude of force which can cause injury. When ring members are fully closed, that strong clamping force is necessary to securely lock the binder and prevent its unintentional opening. Unfortunately, that magnitude of force is also applied to the ring members while they are being opened or closed, causing difficulty in opening and closing the ring members, as well as the hazardous snapping action. Further, the clamping force within each ring is not uniform with the clamping force in other rings, causing uneven movement and potentially resulting in gaps on closed rings.

Another drawback to ring binders of the prior art is that mounting posts securing the binder to a cover often interfere with operation of components of the binder. For example, some binders have control slides operatively connected to levers for movement of the control slide lengthwise of the binder to open and close ring members. The control slides, however, must be specially formed to receive the mounting post through the control slides in order to operate. Manufacturing ring binders with these control slides can be time consuming and costly.

Accordingly, it would be beneficial to provide a ring binder in which a control slide is operatively connected to a lever by a connector capable of transmitting force from the lever to the control slide around a mounting post without requiring the control slide to be specially formed to receive the mounting post.

SUMMARY OF THE INVENTION

A ring binder mechanism for retaining loose-leaf pages generally comprises an elongate plate and hinge plates supported by the elongate plate for pivoting motion relative to the elongate plate. The mechanism also includes rings for holding loose-leaf pages. The rings each include a first ring member and a second ring member. The first ring member is mounted on a first hinge plate and is moveable with the pivoting motion of the first hinge plate relative to the second ring member between a closed position and an open position. In the closed position, the two ring members form a substantially continuous, closed loop allowing loose-leaf pages retained by the rings to be moved along the rings from one ring member to the other. In the open position, the two ring members form a discontinuous, open loop for adding or removing loose-leaf pages from the rings. An actuator is supported for pivoting motion by the elongate plate for actuating the ring members between the closed and open positions. A travel bar is movable generally in translation lengthwise of the elongate plate, and is operatively connected to the actuator by a connector. The connector allows pivoting motion of the actuator to produce the translational movement of the travel bar lengthwise of the elongate plate.

Other objects and features of the present invention will be in part apparent and in part pointed out hereinafter.

BRIEF DESCRIPTION OF THE DRAWINGS

Corresponding reference characters indicate corresponding parts throughout the views of the drawings.

DETAILED DESCRIPTION

Figure 1:
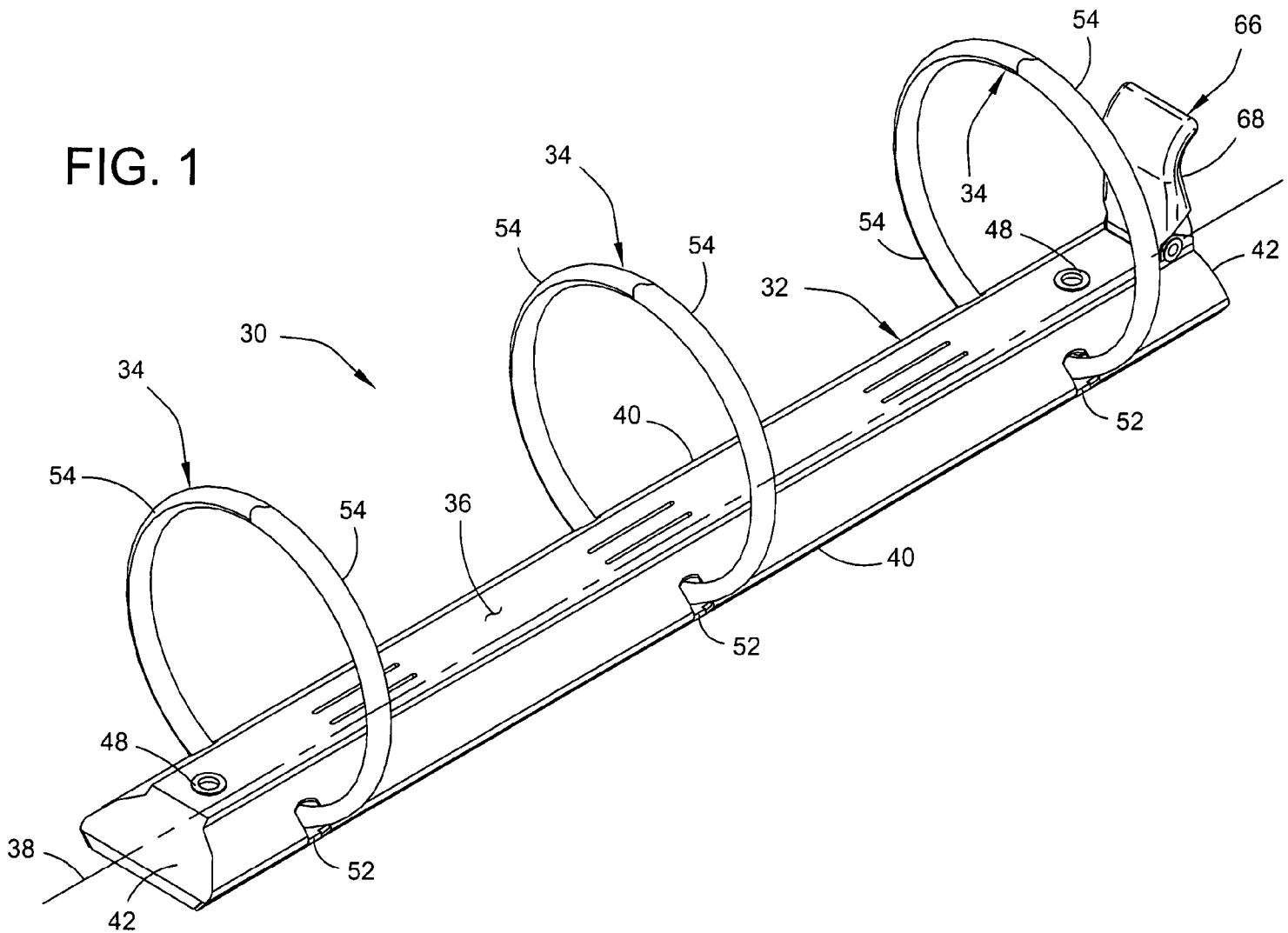
FIG. 1 is a perspective of a ring binder mechanism of a first embodiment of the present invention.

Referring now to the drawings and in particular to FIG. 1, a ring binder mechanism according to the present invention for retaining loose leaf pages is indicated generally at 30. The mechanism 30 includes an elongate plate 32 and three rings, each indicated generally at 34, for holding loose leaf pages.

Figure 2:
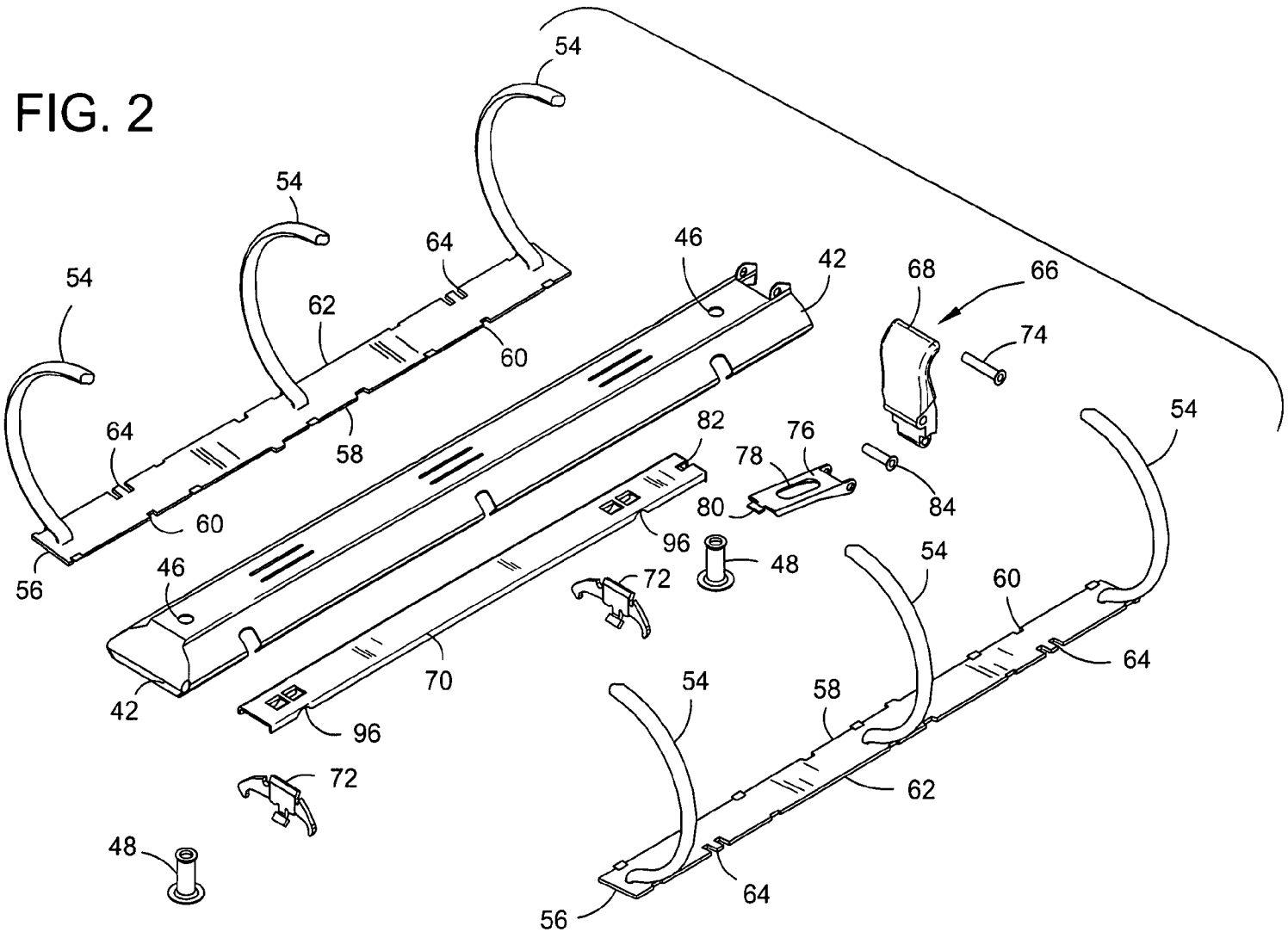
FIG. 2 is an exploded perspective thereof.

The plate 32 is shaped as an elongated rectangle with a uniform, generally arch-shaped elevated profile having at its center a raised plateau 36. The plate 32 has a longitudinal axis 38, two generally opposite longitudinal edges 40, and two generally opposite transverse ends 42. A bent under rim 44 (FIG. 9) is formed along the longitudinal edges 40. The elongate plate 32 is made of metal or other suitable material which is sufficiently rigid to provide a stable mount for other components of the mechanism, while being lightweight to conserve material and manufacturing costs. Two openings 46 (FIG. 2) are provided for receiving and attaching mounting posts 48 to secure the mechanism to a file or notebook 50 (FIG. 11), and six additional holes 52 are positioned along the longitudinal edges 40 to receive the rings therethrough. Mechanisms having plates or housings of other shapes, including irregular shapes, or housings which are integral with a file or notebook, do not depart from the scope of this invention.

Each of the three rings 34 include two half ring members 54 which are movable between a closed position (FIGS. 1 and 3) wherein each ring member forms a continuous, closed loop for retaining loose leaf pages, and an open position (FIG. 5) wherein each ring member forms a discontinuous, open loop suitable for adding or removing pages. The ring members 54 are formed of a conventional, cylindrical rod of a suitable material such as steel. Although both ring members 54 of each ring 34 are movable in the illustrated embodiment, a mechanism having a movable ring member and a fixed ring member does not depart from the scope of this invention. Further, a mechanism with a different number of rings, greater or less than three, does not depart from the scope of this invention.

The ring members 54 are mounted on hinge plates 56 (FIGS. 2 and 3) which are supported by the elongate plate 32 for pivotal motion to move the ring members between the closed and open positions. The hinge plates 56 are mounted in parallel arrangement and attached to each other for pivotal motion along adjoining longitudinal edges to form a hinge 58. Two pairs of aligned notches 60 in the hinge plates 56 are positioned along the hinge and define openings, the use of which will be explained hereinafter. Each hinge plate 56 has an outer longitudinal edge margin 62 opposite the hinge which is received in the corresponding bent under rim 44 of the elongate plate 32. The longitudinal edge margins 62 are free to move within the rim 44 to allow pivoting movement of the hinge plates 56 on the hinge 58. The elongate plate 32 provides a small spring force to bias the hinge plates 56 to pivot away from a co-planar position (i.e., toward either the closed position or the open position). However, the biasing force provided by the elongate plate 32 is substantially smaller than on conventional ring binder mechanisms, and the plate provides effectively no clamping force to hold the ring members 54 in the closed position as with conventional mechanisms. The elongate plate 32 provides a force which is as small as it can be while still supporting the hinge plates 56. Each hinge plate 56 also has several locating cutouts 64 along the outer longitudinal edge margin 62 for a purpose described hereinafter.

A unique control structure indicated generally at 66 is provided for controllably pivoting the hinge plates 56 and thereby moving the ring members 54 between the closed and open positions, as well as for controllably locking the ring members at the closed position. The control structure 66 includes a single actuating lever 68 at one end of the mechanism, a travel bar 70, and two connecting links 72 which are supported by the elongate plate 32 and are movable relative to the elongate plate. The connecting links 72 operatively connect the travel bar 70 to the hinge plates 56.

The actuating lever 68 selectively moves the ring members 54 between the open and closed positions and moves the mechanism to a locked position. The lever 68 is pivotally mounted by a hinge pin 74 to one end 42 of the elongate plate 32 in a position readily accessible for grasping and moving the lever. The opposite end 42 of the elongate plate is free from any actuator, although it is understood that a mechanism with two levers does not depart from the scope of this invention. The lever 68 is operatively connected to the travel bar 70 such that application of force to the lever produces movement of the travel bar generally lengthwise of the elongate plate 32. The pivotal motion of the lever 68 provides for easier application of force by an operator when moving the travel bar 70 than it would be to translate the bar directly as by pushing or pulling, and does so without the bar protruding from the elongate plate. A suitable rigid material or combination of materials, such as metal or plastic, forms the lever 68.

An intermediate connector 76 is pivotally connected to the lever 68 and to the travel bar 70 for pivoting motion relative to both the lever and travel bar. Force is transmitted from the lever 68 to the travel bar 70 through the intermediate connector 76. The intermediate connector 76 has an elongate slot 78 for allowing the intermediate connector to move while receiving a mounting post 48 through the slot. The slot 78 allows transmission of force around the post 48 while keeping direction of force along a centerline of the intermediate connector 76. The intermediate connector 76 has a tabbed end 80 for being received in a slot 82 on an end of the travel bar 70 for permitting relative pivoting motion. A hinge pin 84 attaches the intermediate connector 76 to the lever 68.

Figure 14:
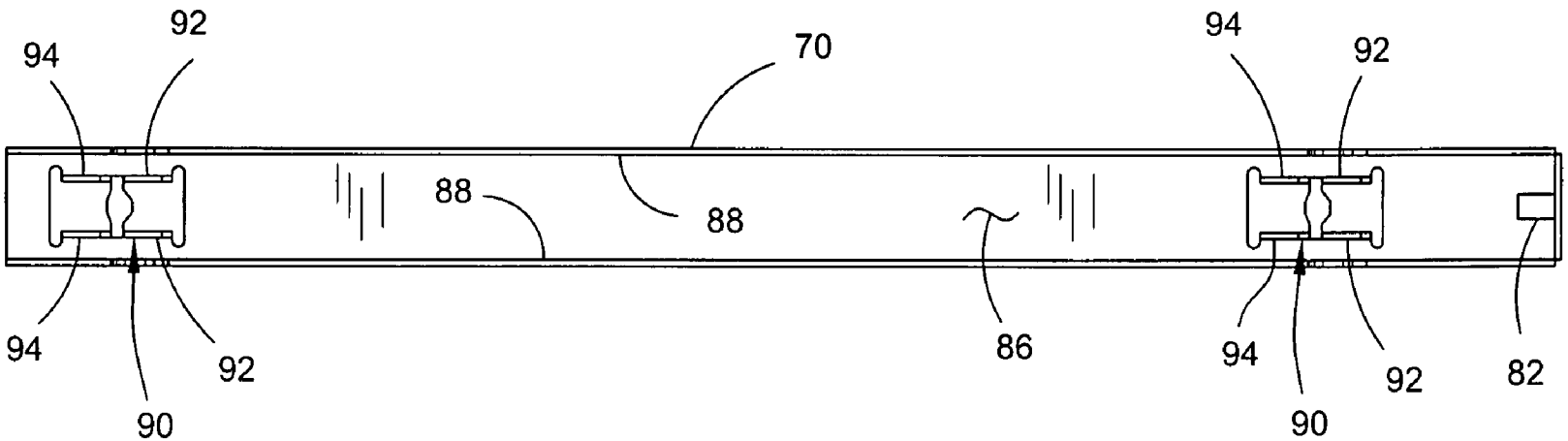
FIG. 14 is a bottom plan of a travel bar of the mechanism of the first embodiment.

The travel bar 70 (FIG. 14) is elongate in shape and disposed in generally parallel arrangement with the longitudinal axis 38 of the elongate plate 32. It is movable generally lengthwise of the elongate plate, being pivotally supported by the connecting links 72. The travel bar 70 is housed within the elongate plate 32 behind the raised plateau 36. In one embodiment, the travel bar 70 has the shape of a rigid channel, with a flat web 86 and downwardly turned side flanges 88.

Two mounts, indicated generally at 90, are on the travel bar 70 for pivotally attaching the travel bar and connecting links 72. Each mount 90 includes stops 92, 94 (FIG. 10) formed by punching and bending portions of the web 86. Two stops 92 are arranged on a first longitudinal side of the mount 90 and two stops 94 on the opposite side. The stops limit an angular extent of pivotal motion of the connecting link 72 relative to the travel bar 70. Each stop 92, 94 has an angled surface configured for engagement by the connecting link 72. The stops are directionally configured, i.e., the angle of surfaces on stops 92 differs from the angle of surfaces on stops 94 such that a maximum relative angle between the connecting link and travel bar may be greater in one longitudinal direction than in the opposite longitudinal direction. Corresponding notches 96 (FIG. 2) are formed in the flanges 88 of the travel bar 70 at positions adjacent each mount, forming a slot transverse a longitudinal axis of the bar for permitting free pivotal motion of the connecting links 72.

Figure 12:
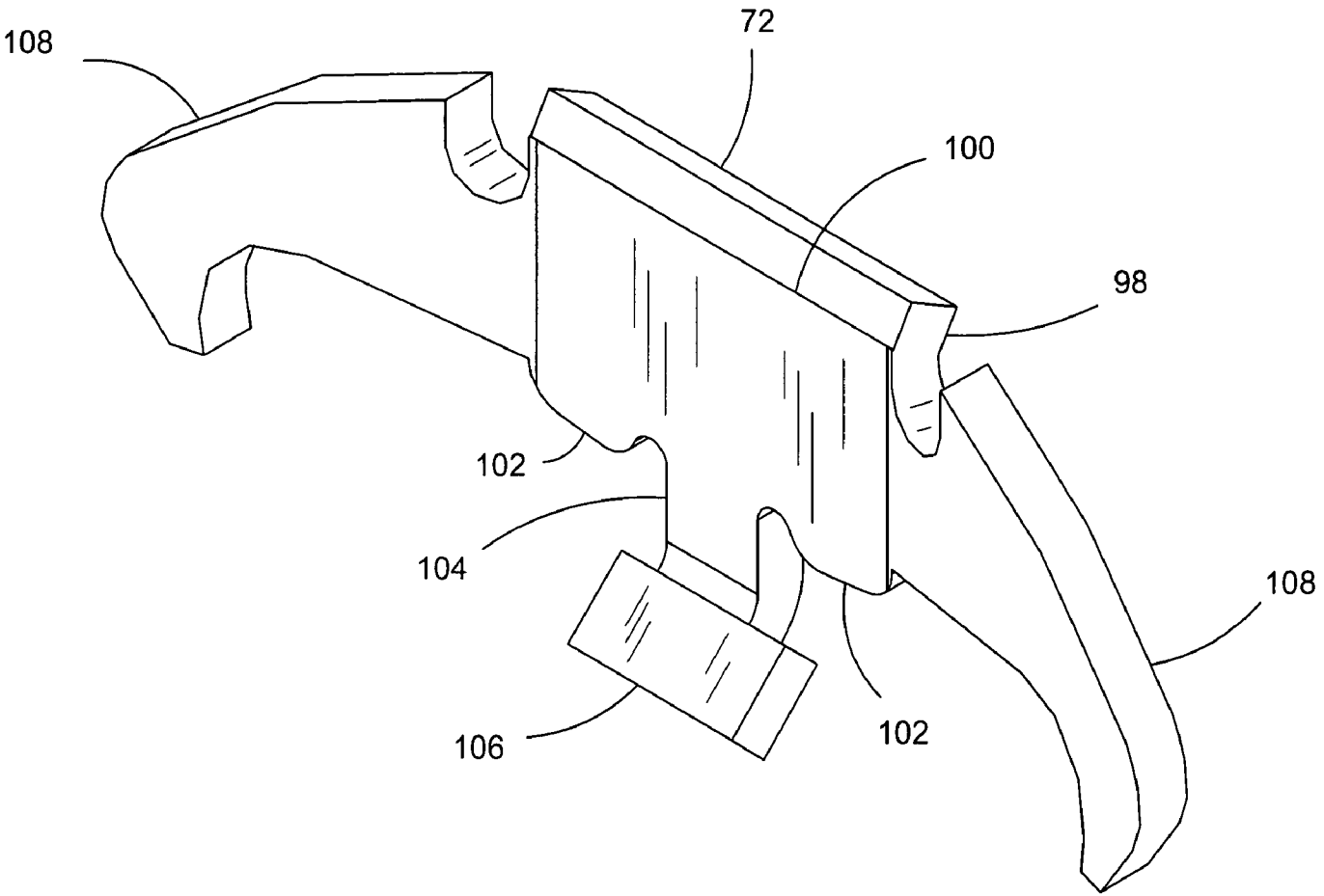
FIG. 12 is an enlarged perspective of a connecting link.

Referring to FIG. 12, each connecting link 72 has a tongue 98 projecting from the top center of the link which is pivotally received in the mount 90, between the stops 92 and 94. The tongue 98 pivots about an axis transverse to the longitudinal axis of the travel bar 70. An upper peripheral edge of the tongue 98 is generally straight and configured to engage the mount 90 for attaching the connecting link 72 to the travel bar 70 in loose fitting relation such that the bar is movable generally lengthwise of the elongate plate 32 while the connecting link pivots with respect to the elongate plate. The tongue 98 is bent at a slight angle relative to the center of the link 72, as shown at line 100 in FIG. 12. That angle inhibits occurrence of the link 72 becoming stopped at a vertical position with little or no tendency to move away from that position when force is oriented generally vertically. The connecting link 72 has two lugs 102 for engaging upper surfaces of the two hinge plates 56 adjacent to the hinge 58. A tab 104 depends from the lower center of the connecting link 72 for being received through the opening defined by the aligned notches 60 at the hinge. The tab 104 is in loose fitting relation with the hinge plates 56 for attaching the connecting link 72 to the hinge plates. A retainer 106 at the bottom of the tab 104 is wider than the opening at the notches 60 to prevent the tab 104 from being fully withdrawn from the opening. The tab 104 is configured to move toward and away from the hinge plates 56 while permitting the connecting link 72 to pivot with respect to the hinge plates. When the link 72 pivots to where the retainer 106 engages the hinge plates 56, the retainer pivots the hinge plates to move the ring members 54 to the open position.

Locating arms 108 extend laterally outwardly from opposite sides of the connecting link 72 for extending through the locating cutouts 64 in the hinge plates 56. The arms 108 attach the link 72 to the hinge plates 56 and locate the link against canting movement, that is, movement about a vertical axis perpendicular to the longitudinal axis 38 of the elongate plate 32. However, ends of the arms 108 are received sufficiently loosely in the locating cutouts 64 so as not to interfere with the pivoting motion of the connecting link 72.

Preferably, the connecting links 72 are formed of a suitable rigid material, such as metal or plastic. It is understood that mechanisms with links formed of a non-rigid material do not depart from the scope of this invention. Further, a mechanism having a different number of connecting links (i.e., greater or less than two) does not depart from the scope of this invention.

Figure 9:
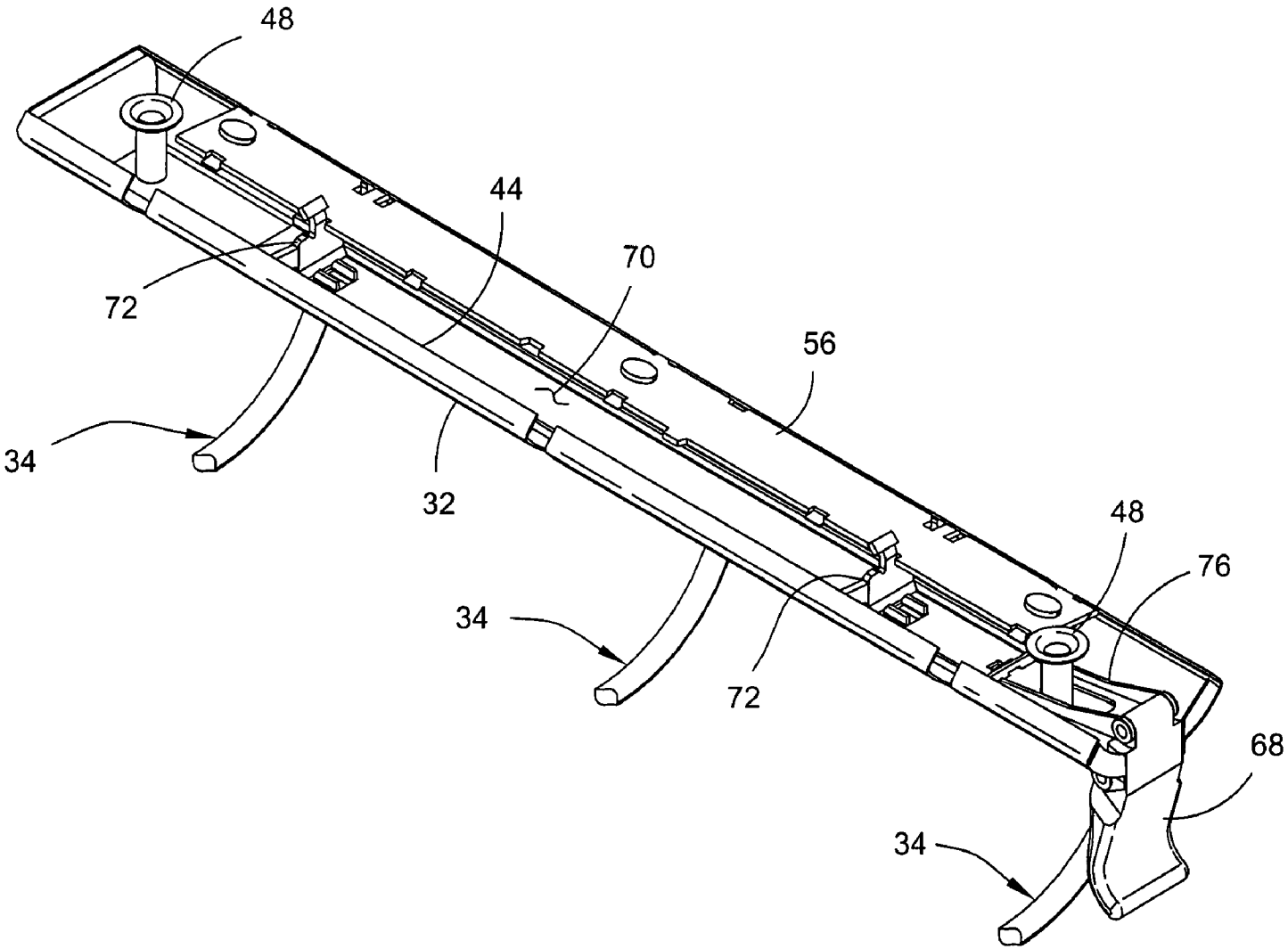
FIG. 9 is a bottom perspective of the ring binder of FIG. 1 at the closed and locked position with one hinge plate removed.
Figure 10:
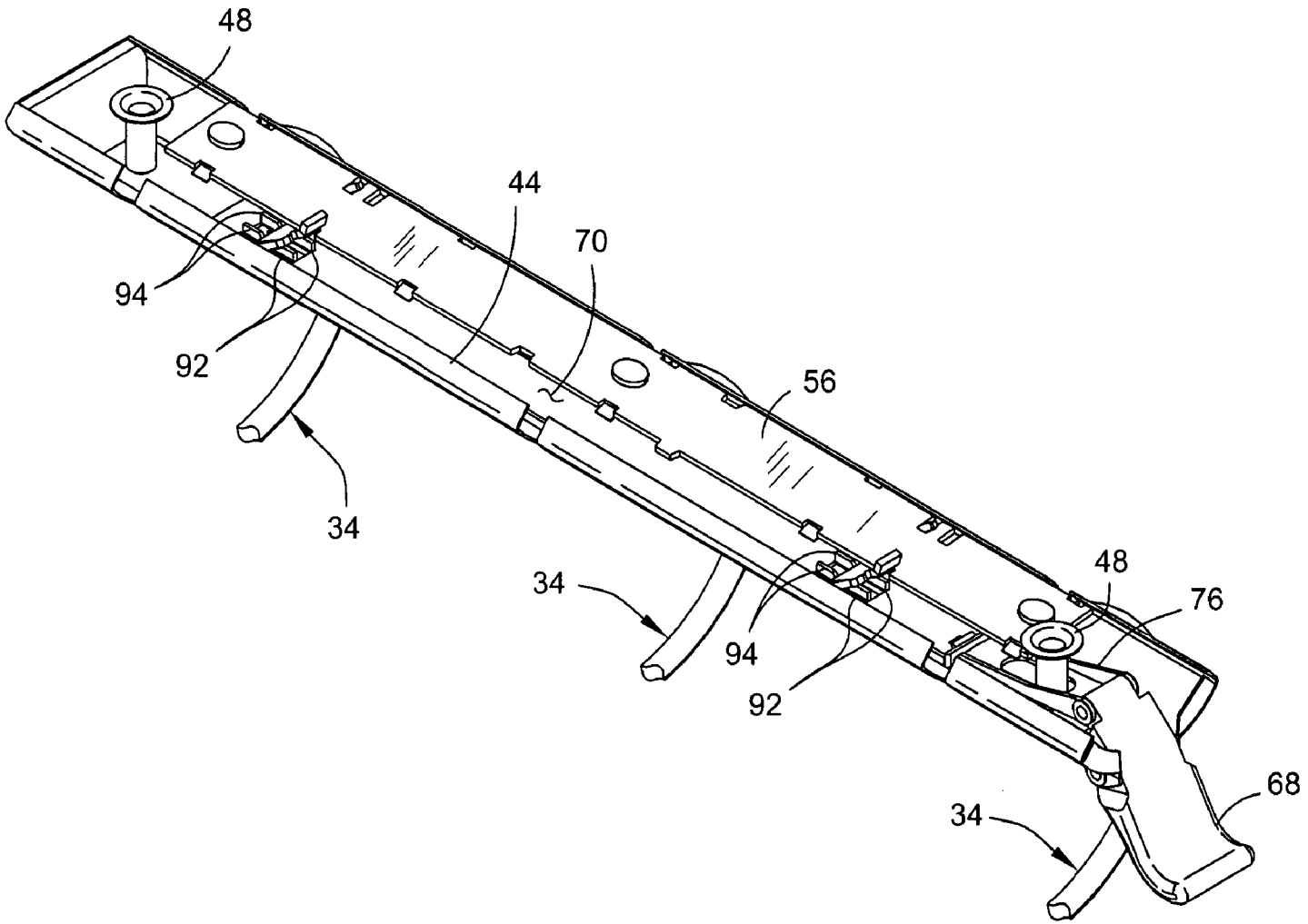
FIG. 10 is a view similar to FIG. 9 with the mechanism at the open position.

The connecting links 72 are at spaced apart locations and positioned longitudinally relative to the rings 34 such that force applied through the lever 68 is distributed generally uniformly among the rings. In the embodiment of FIGS. 9 and 10, there are three rings 34 and two connecting links 72, the links being symmetrically positioned in alternating relation relative to the rings to transmit force to the hinge plates 56 which is generally equally distributed among the three rings. The symmetric positioning of the connecting links 72 avoids problems of uneven force distribution to the rings as on mechanisms of the prior art. The links 72 are positioned closer to the endmost rings 34, each at a spacing between about one-fourth and one-third of the distance between the endmost and centermost rings. It will be understood that other quantities of connecting links 72 and other spacings do not depart from the scope of this invention.

The components of the mechanism 30 are made of a suitable rigid material, such as a metal (e.g., steel). Mechanisms made of non-metallic materials, specifically including a plastic, do not depart from the scope of this invention.

Figure 3:
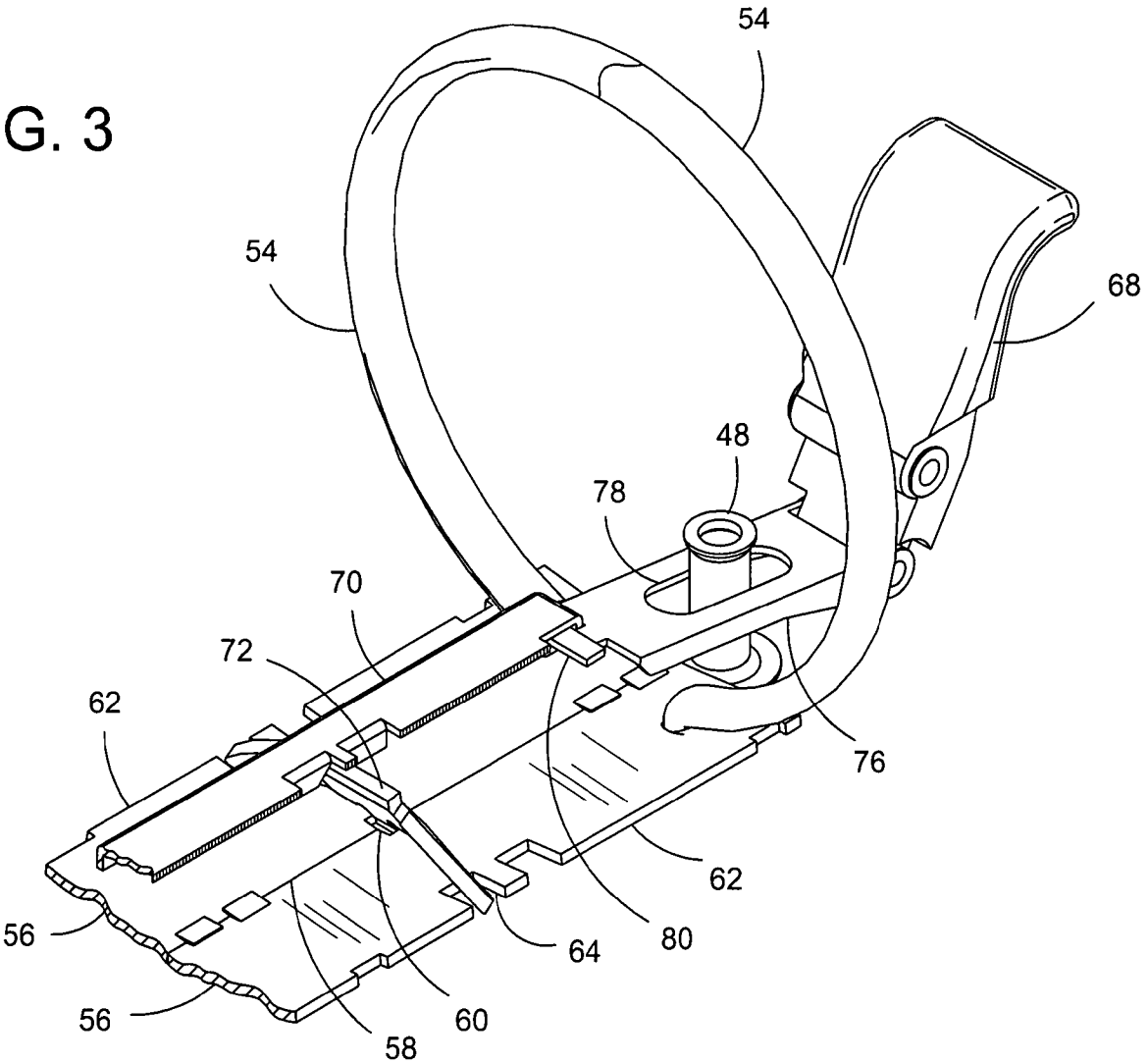
FIG. 3 is a fragmentary perspective of the mechanism with an elongate plate thereof removed and in a closed and unlocked position.
Figure 4:
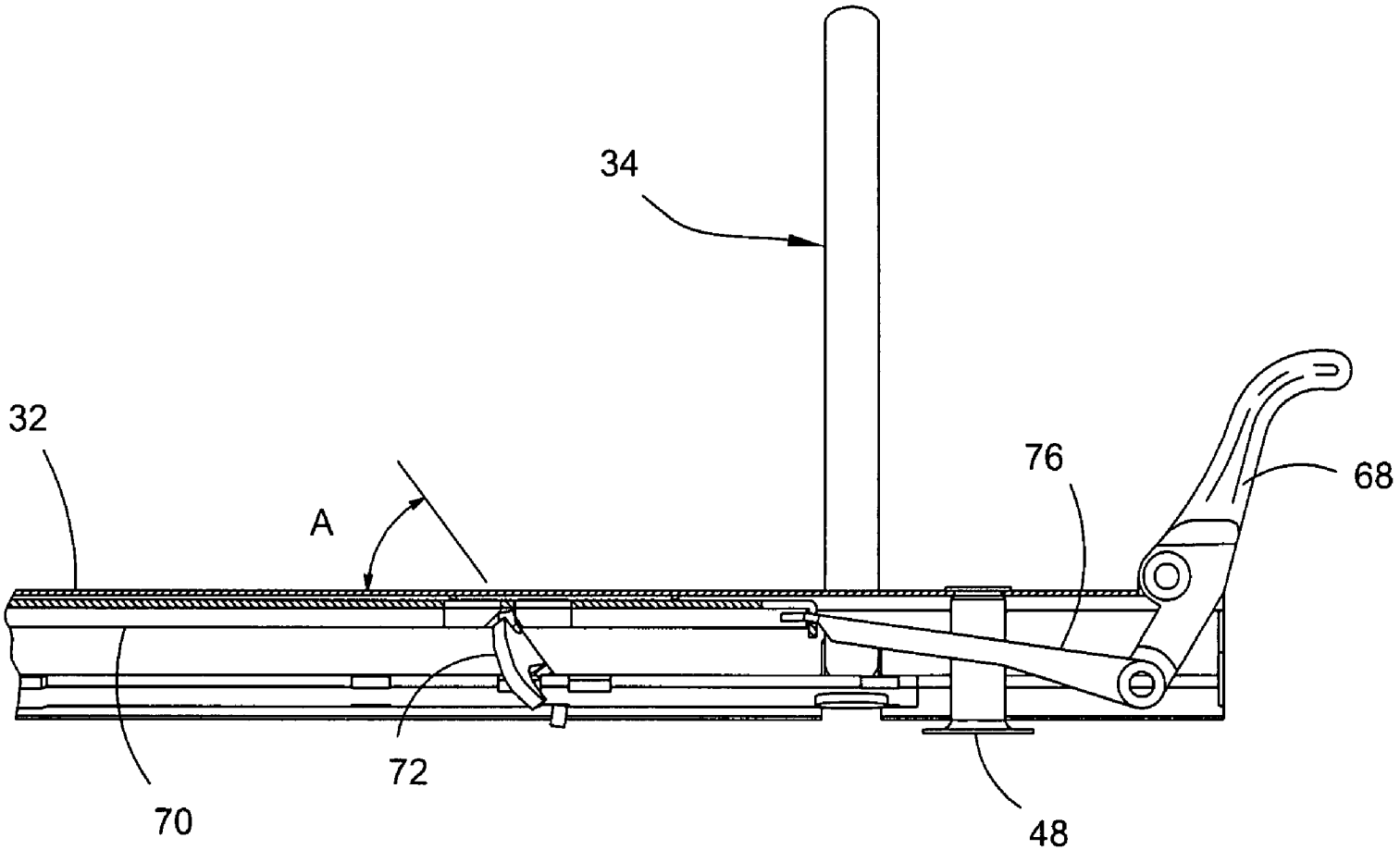
FIG. 4 is a fragmentary longitudinal section of the mechanism at the closed and unlocked position.
Figure 5:
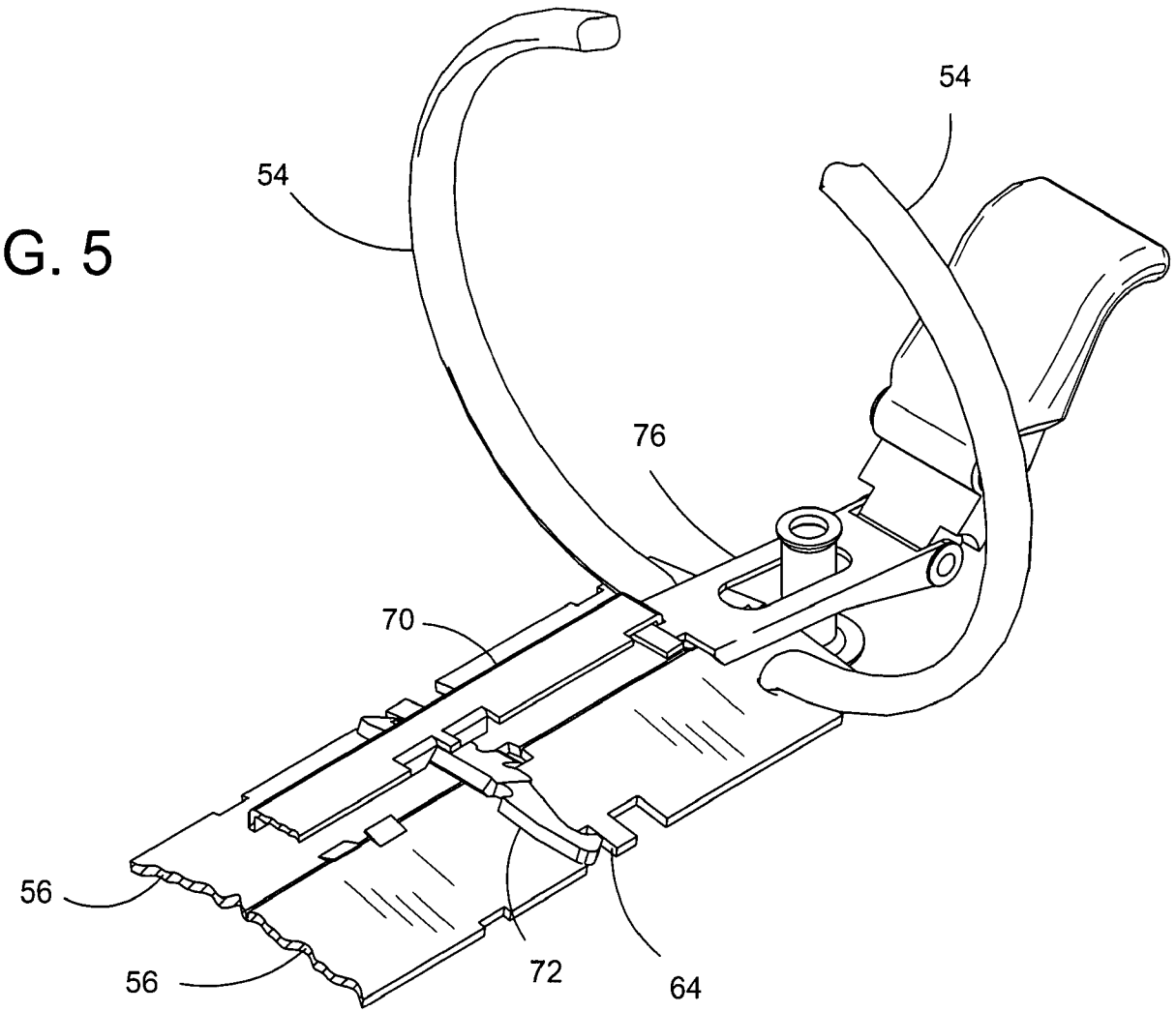
FIG. 5 is a view similar to FIG. 3 with the mechanism at an open position.
Figure 6:
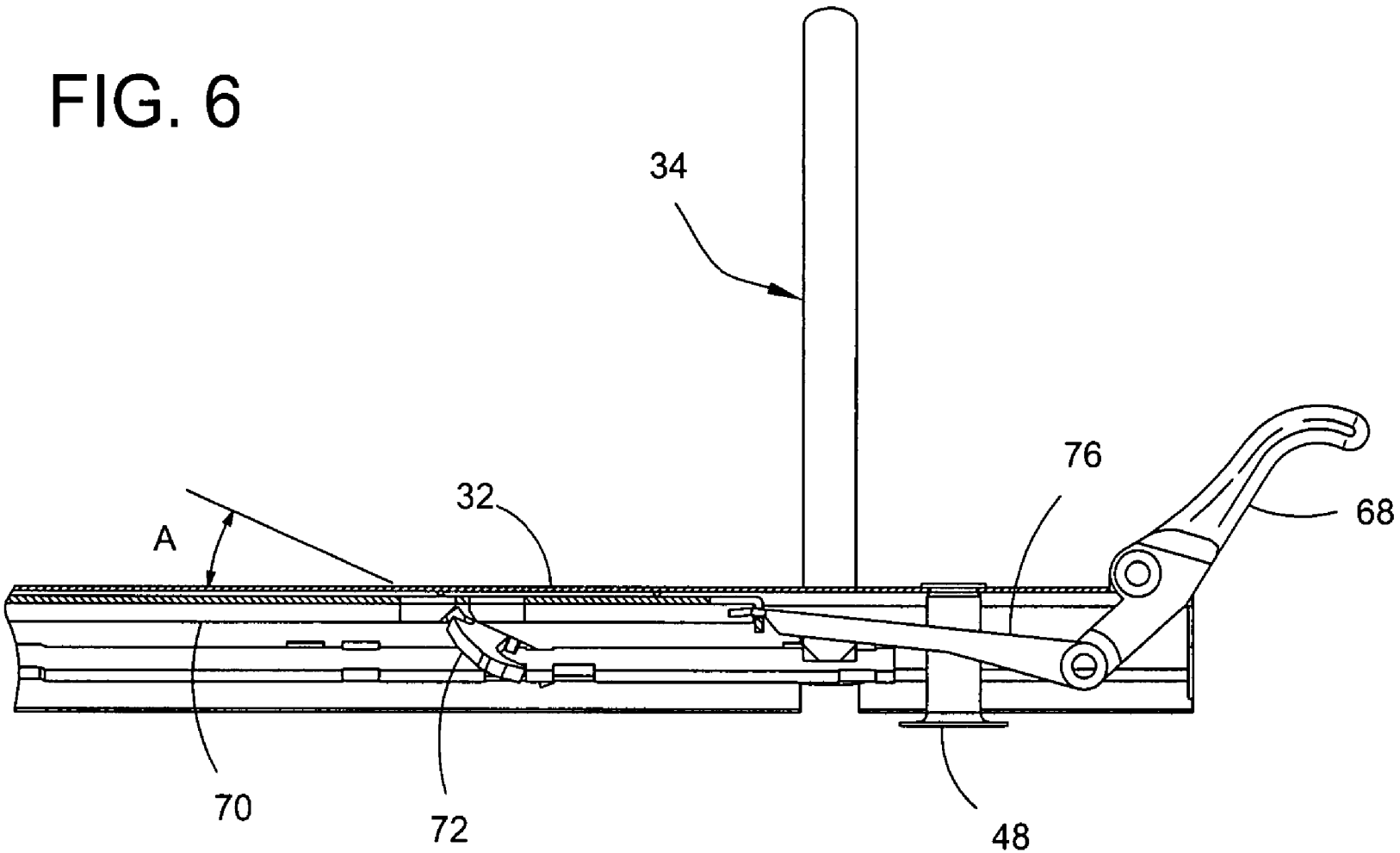
FIG. 6 is a view similar to FIG. 4 with the mechanism at the open position.
Figure 7:
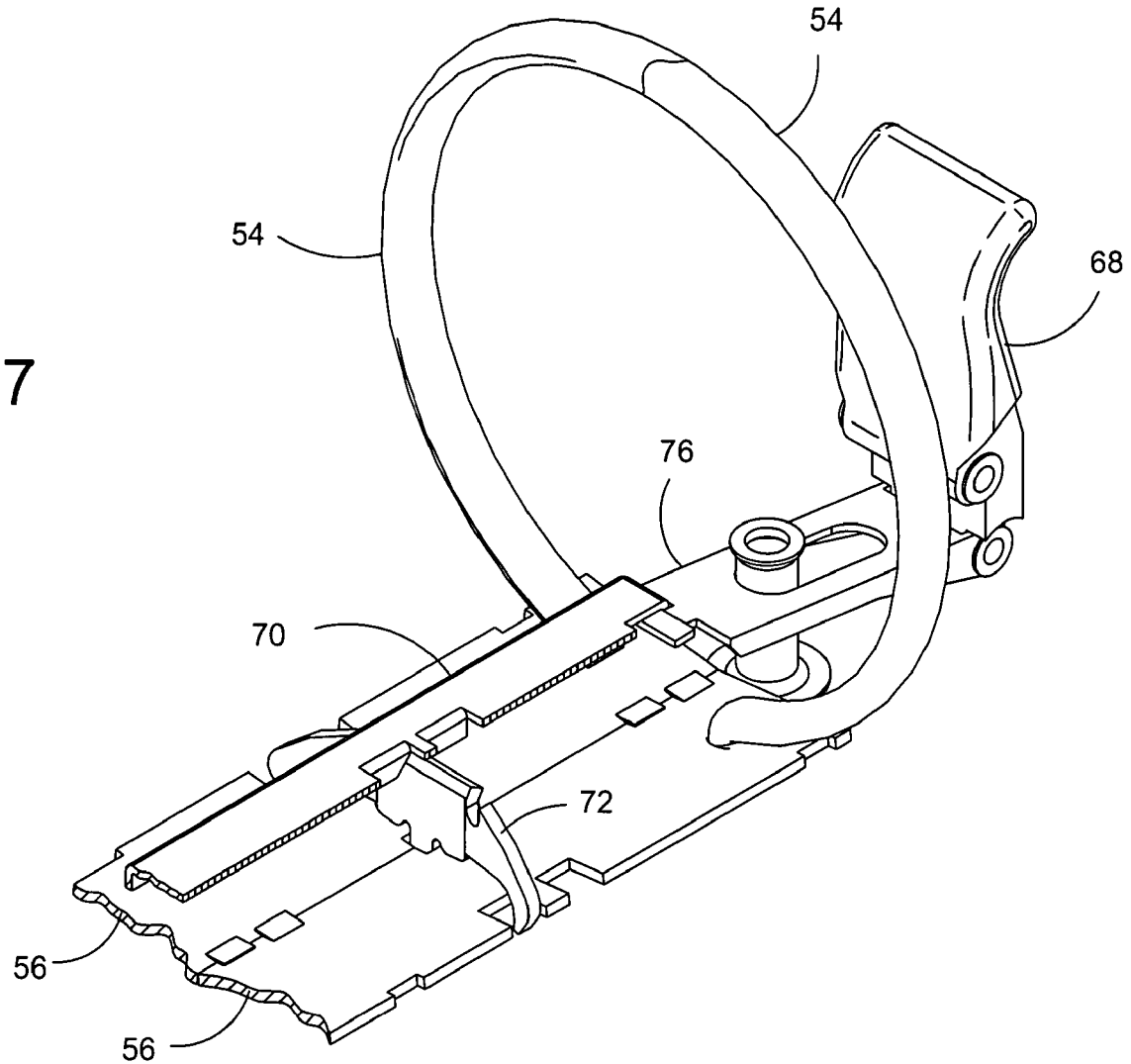
FIG. 7 is a view similar to FIG. 3 with the mechanism at a closed and locked position.
Figure 8:
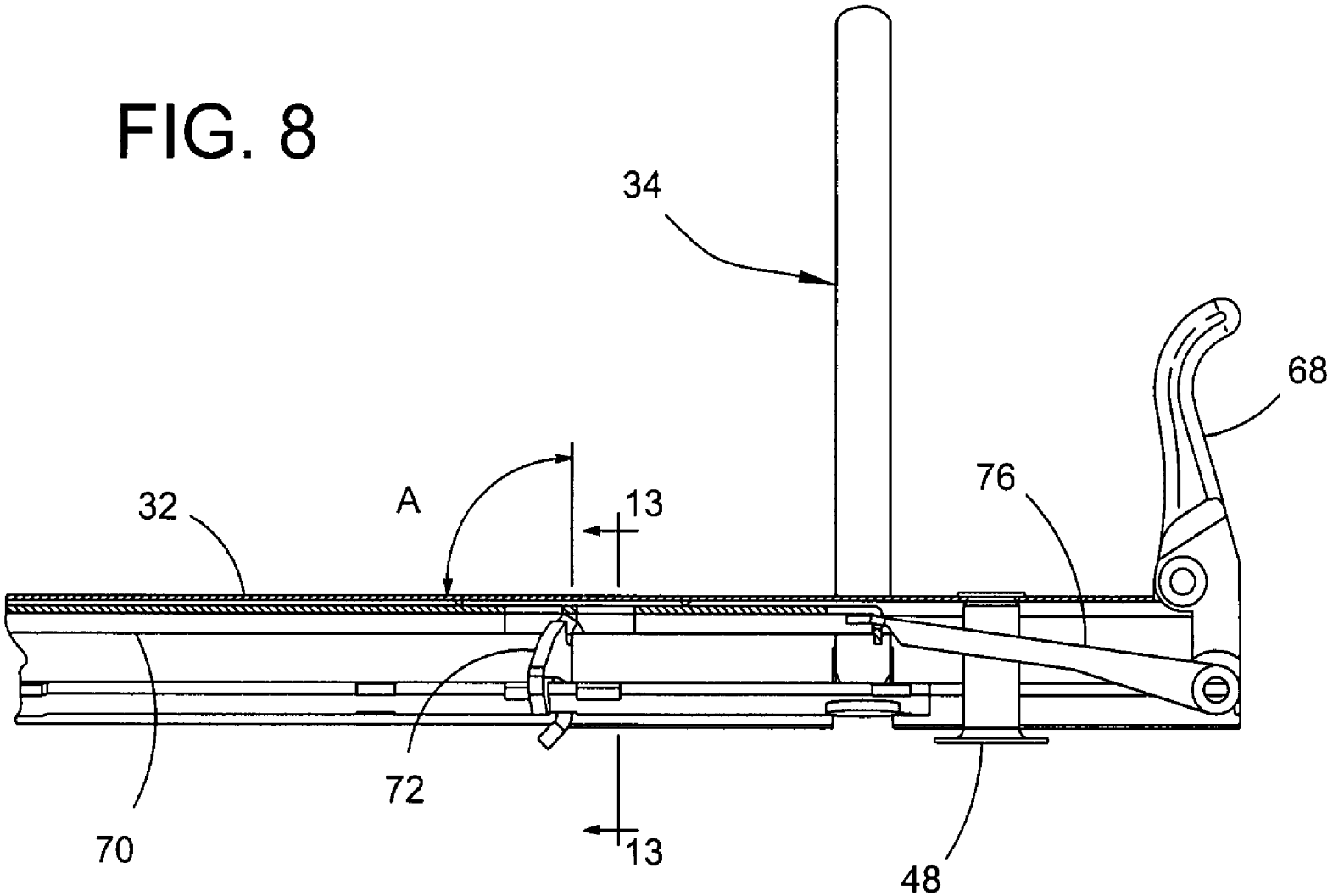
FIG. 8 is a view similar to FIG. 4 with the mechanism at the closed and locked position.

In operation, the control structure 66 is configured to selectively place the mechanism 30 at three primary positions:

First position: Ring members 54 open (FIGS. 5 and 6);

Second position: Ring members 54 closed and unlocked (FIGS. 3 and 4);

Third position: Ring members 54 closed and locked (FIGS. 7 and 8).

In order to move from the first position to the second and third, an operator applies force to the lever 68 to progressively pivot the lever upwardly. That pulls the intermediate connector 76 and travel bar 70 such that they move toward the end 42 of the elongate plate 32 having the lever. As the travel bar 70 moves, both connecting links 72 are simultaneously and pivotally moved to a more upright position. For instance, typical angles A (FIGS. 4, 6, and 8) of the connecting link 72 relative to the elongate plate 32 are about 30 degrees at the first position, about 45 degrees at the second position, and about 95 to 100 degrees at the third position. Other angles do not depart from the scope of this invention.

The angle of the connecting links 72 in turn controls the position of the hinge plates 56. When closing the ring members 54, the lugs 102 on the connecting links engage the upper surfaces of the hinge plates 56, pushing them downward to pivot the hinge plates and thereby close the ring members. Conversely, when opening the ring members 54, the tabs 104 of the connecting links engage the lower surfaces of the hinge plates 56 to pivot the hinge plates in the opposite direction.

At the second, unlocked position, any force which tends to open the ring members 54 is not opposed. Because the hinge plates 56 receive substantially no tension from the elongate plate 32, a light finger pressure on the ring members is sufficient to move the ring members 54 to the first, open position, or back to the second, closed and unlocked position. Such force needs only overcome internal friction of the mechanism and the small spring force biasing the hinge plates 56 away from a co-planer position. There is no strong snapping motion as on conventional mechanisms. The force pivots the hinge plates 56, pushing up on the lugs 102 of the connecting links 72, and thereby pivoting the links to a different angle A.

A strong clamping force is not being applied while the ring members 54 in the rings 34 move between the first (open) and second (closed and unlocked) positions. Unlike binders of the prior art, the elongate plate 32 does not provide significant tension to the hinge plates and rings. Accordingly, the force is relatively less when the ring members are moving. That permits the ring members to be easily opened or closed using less strength by an operator. It also inhibits injury should the operator inadvertently place a finger or hand in position between ring members 54 while they are being clamped together.

Figure 13:
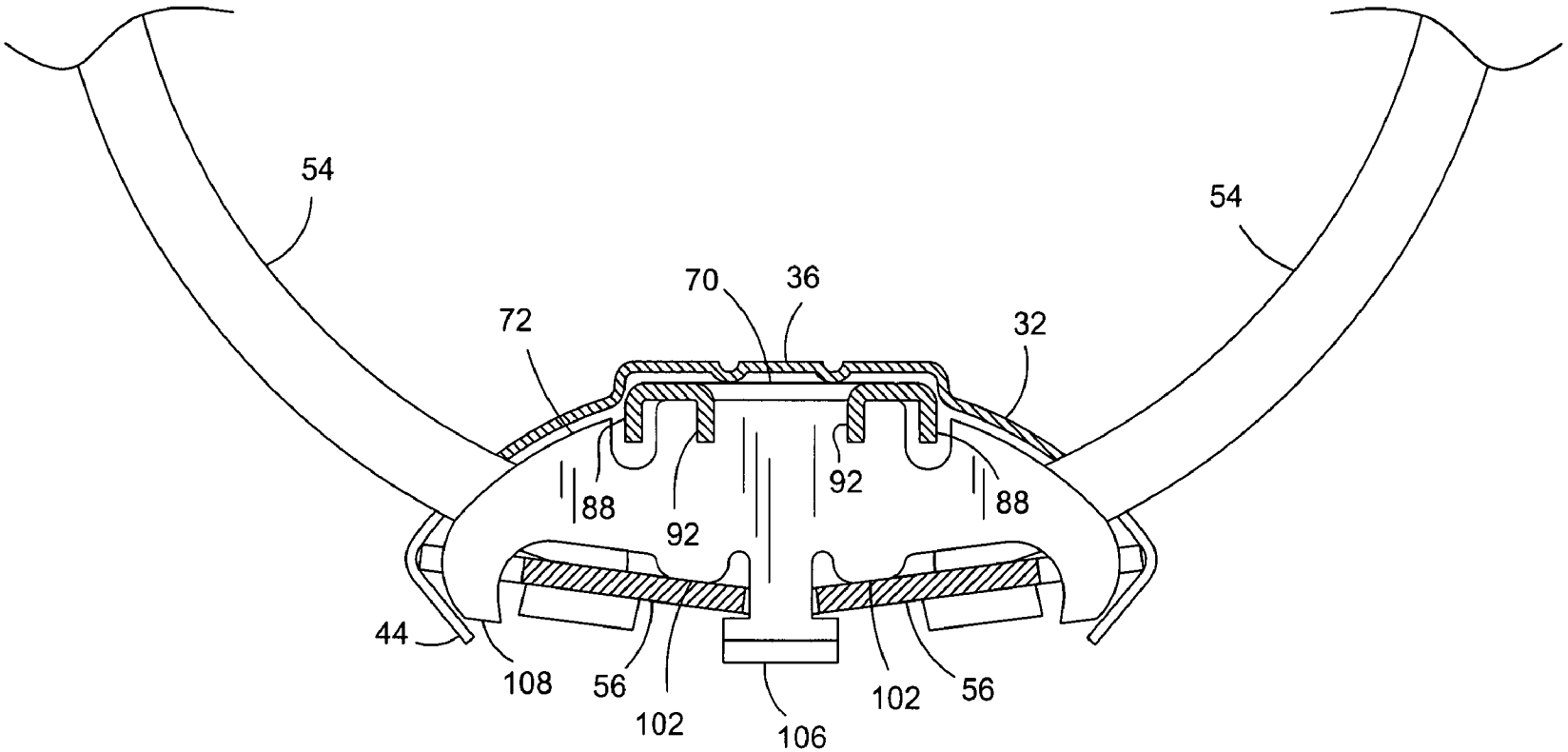
FIG. 13 is a section taken on line 13-13 of FIG. 8.

When the connecting links 72 reach an angle A of 90 degrees (not shown), which is between the second and third positions and substantially closer to the third position, the mechanism 30 is at a critical locked position. As shown in FIG. 13 for the third (locked) position, force tending to open the ring members 54 is firmly opposed by the connecting links 72 which are vertically oriented. When the hinge plates 56 push up on the lugs 102, there is little tendency to pivot or move the mechanism toward the open position because force applied to the ring members 54 urges the connecting links to move vertically upward. That motion is strongly opposed by the mechanism because the links push up on the travel bar 70 which is captured beneath the elongate plate 32. Clamping force in the rings 34 is maximized because the connecting links 72 are perpendicular between the travel bar 70 and hinge plates 56, providing a maximum spacing between those components to apply maximum force to the hinge plates. At the third, locked position the mechanism is moved to where the connecting links 72 reach an angle A slightly past the critical position (i.e., to 95 to 100 degrees) to insure stability and avoid inadvertent movement to an unlocked position. The links 72 engage the stops 92 at that position.

Figure 11:
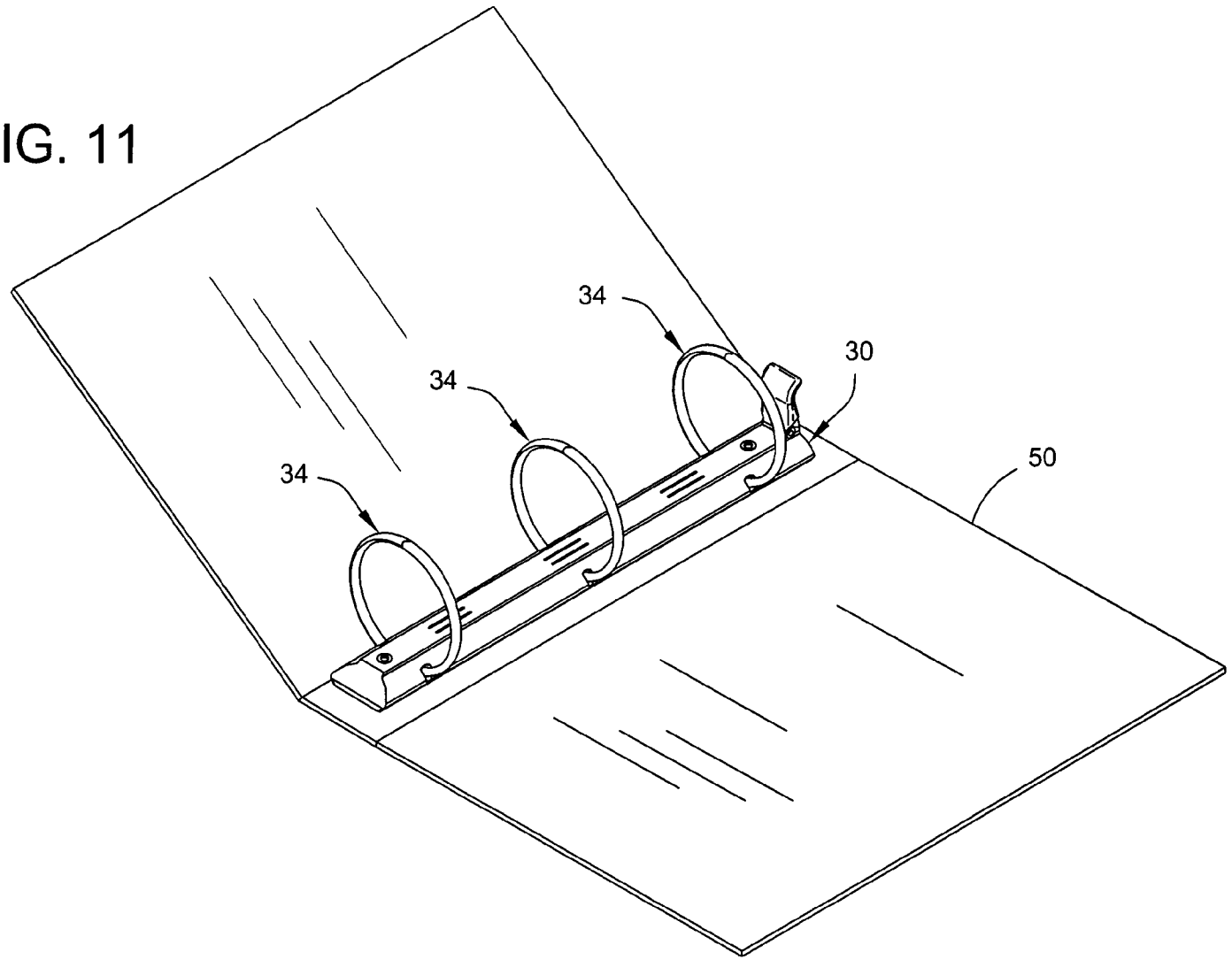
FIG. 11 is a perspective of a notebook incorporating the ring binder mechanism.

As shown in FIG. 11, the ring binder mechanism may be mounted on a cover of a notebook 50. The cover is movable to selectively cover and expose loose leaf pages retained on the rings 34.

One method according to the present invention opens or closes the ring binder mechanism 30 having ring members 54. The method comprises the steps of mounting the ring members 54 on pivotable hinge plates 56 such that pivoting of the hinge plates moves the ring members between open and closed positions. The hinge plates 56 are operatively connected with the travel bar 70 by placing at least one pivotally movable connecting link 72 between the hinge plates and the bar such that motion of the bar produces pivotal motion of the hinge plates. Force is applied to the travel bar 70 to move the bar, thereby pivoting the connecting links 72 to open or close the ring members 54. A step of locking the mechanism 30 includes applying force to the travel bar 70 to move the bar and thereby pivot the connecting links 72 to incline the connecting links to at least the critical locked position (angle A of 90 degrees or greater) wherein opening of ring members is inhibited.

The binder mechanism 30 of the present invention effectively retains loose leaf pages. The mechanism does not snap shut with a strong force which might injure a person who inadvertently places a finger or hand between ring members as they clamp together. The ring members 54 may be moved by application of force at only one end 42 of the elongate plate, and the magnitude of force is less than on ring binders of the prior art. The mechanism distributes force generally uniformly to the three rings 34. The binder may be controllably placed in a locked position for securing loose leaf sheets.

Figure 15:
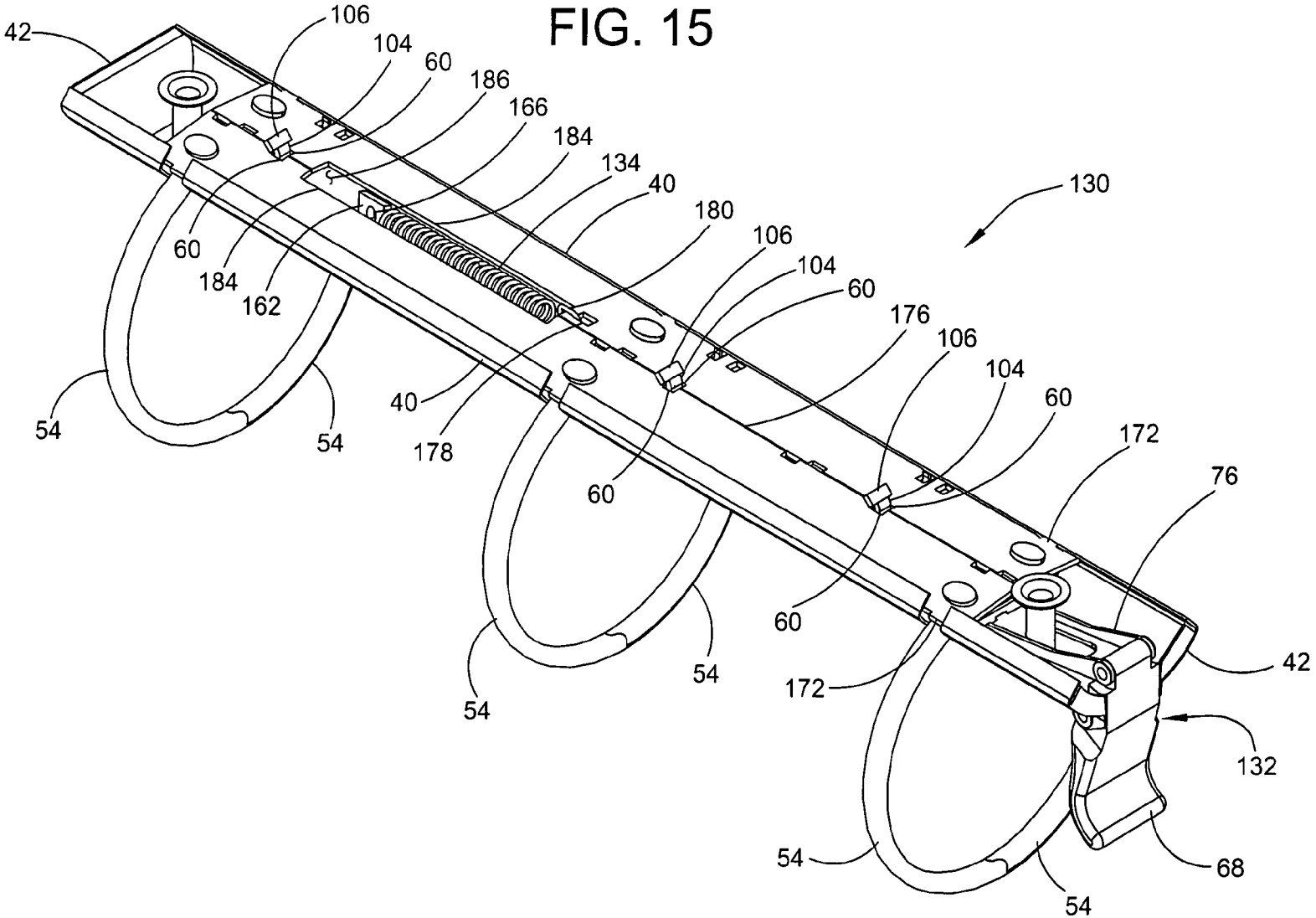
FIG. 15 is a bottom plan view of a ring binder mechanism according to a second embodiment of the present invention with the mechanism at the closed position.
Figure 16:
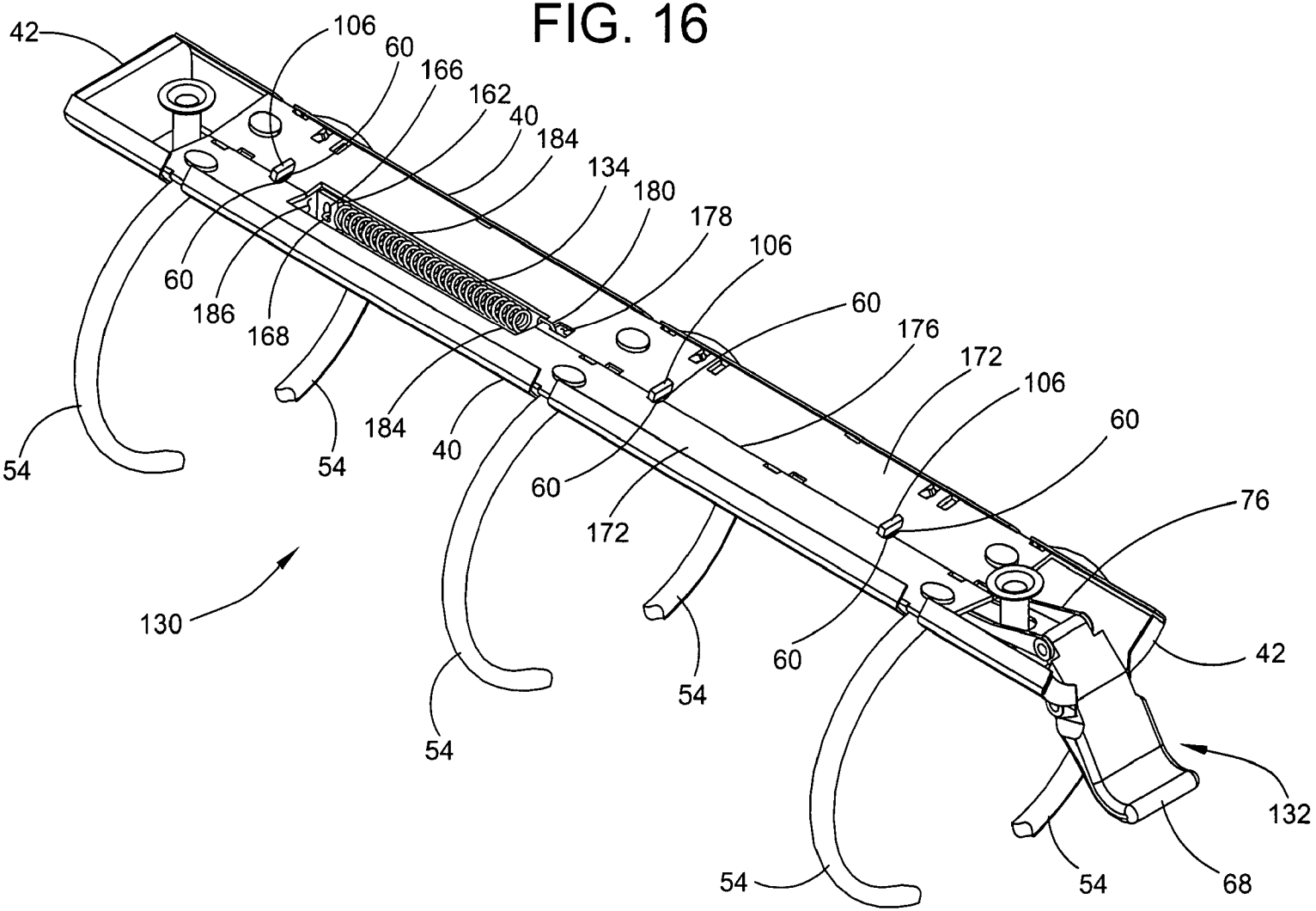
FIG. 16 is a view similar to FIG. 15 with the mechanism at the open position.
Figure 17:
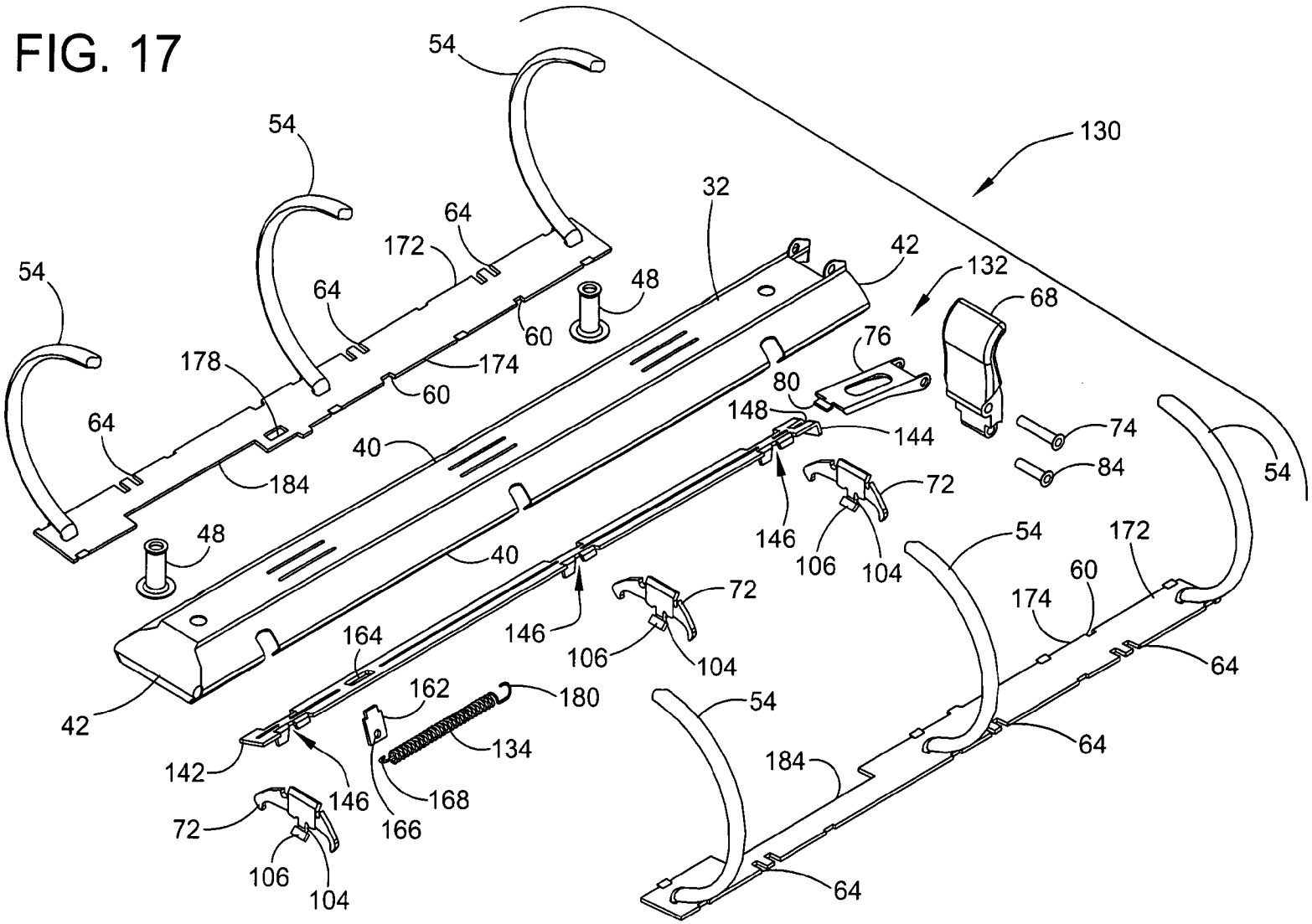
FIG. 17 is an exploded perspective of the second embodiment.
Figure 18:
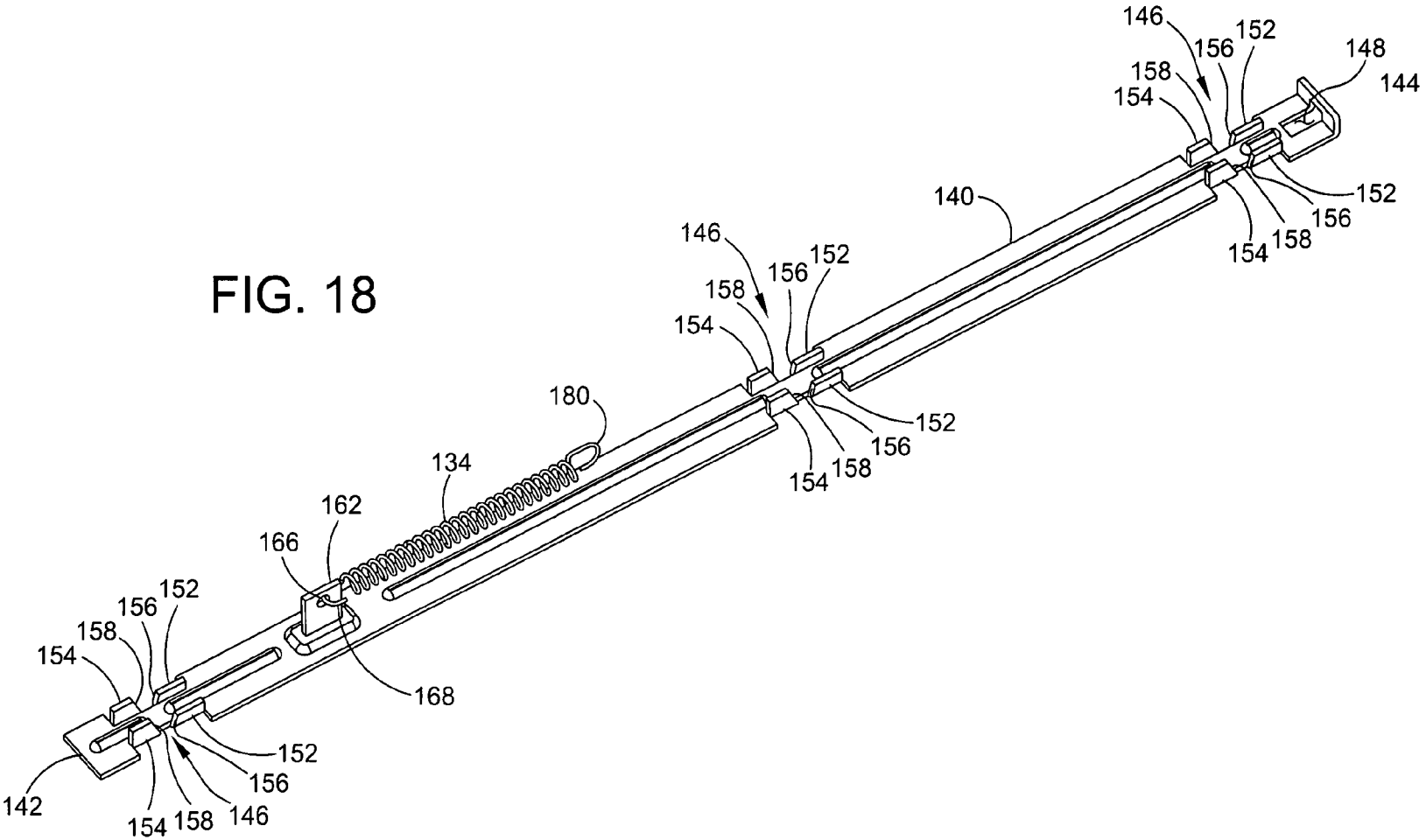
FIG. 18 is an enlarged perspective of a travel bar of the second embodiment.
Figure 18A:
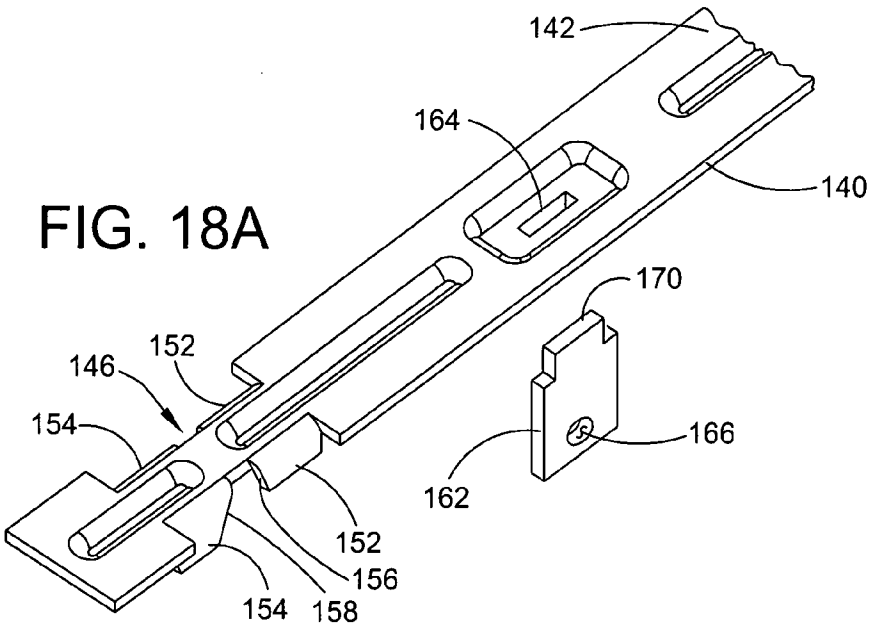
FIG. 18A is an enlarged bottom exploded perspective of the travel bar of FIG. 18 showing a tab unassembled from the travel bar.
Figure 18B:
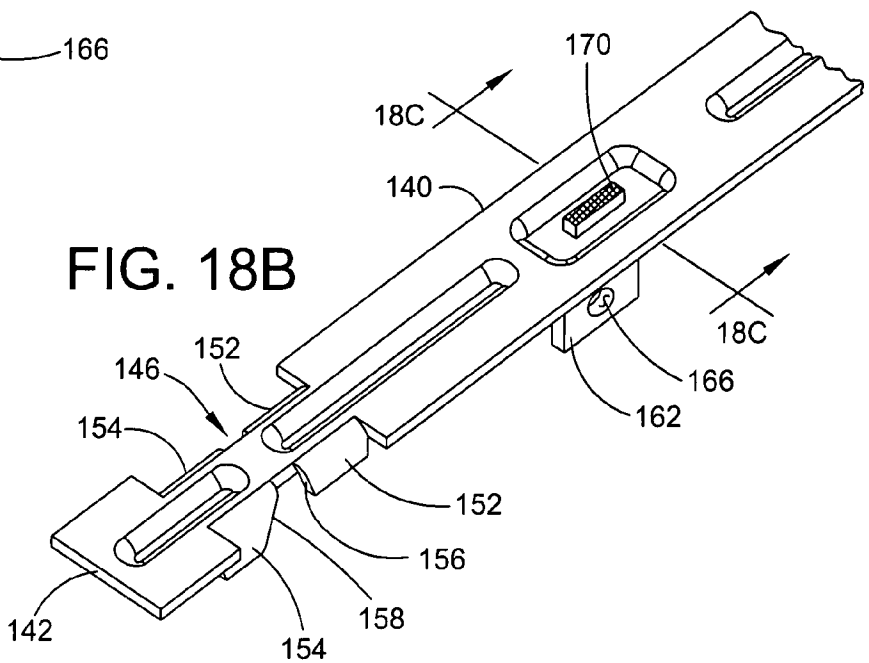
FIG. 18B is an enlarged bottom perspective of the travel bar of FIG. 18A showing the tab assembled to the travel bar.
Figure 18C:
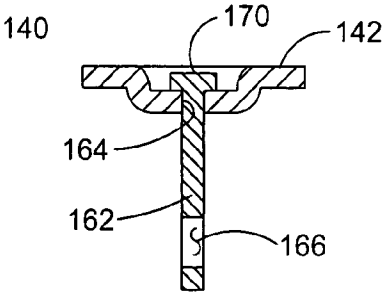
FIG. 18C is a section taken along line 18C-18C of FIG. 18B.
Figure 19:
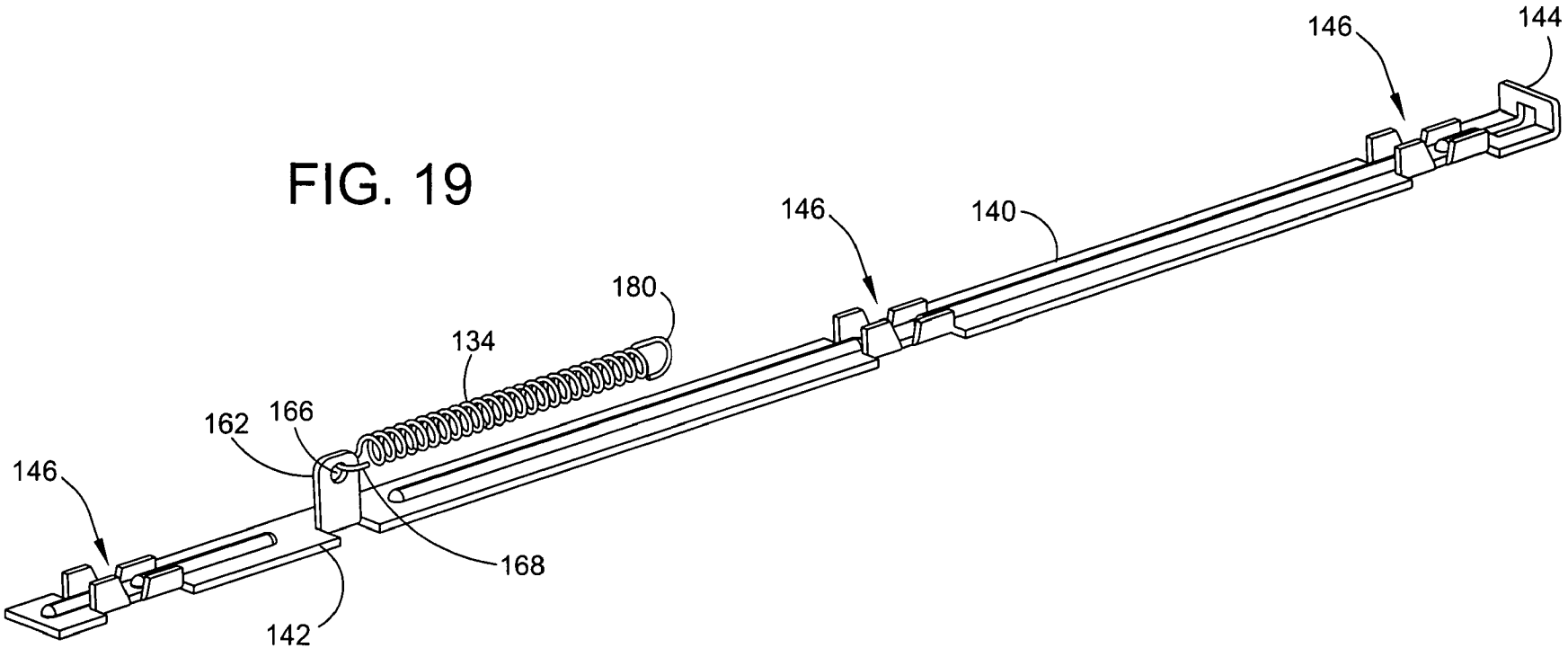
FIG. 19 is an enlarged perspective of a second version of the travel bar of the second embodiment.
Figure 20:
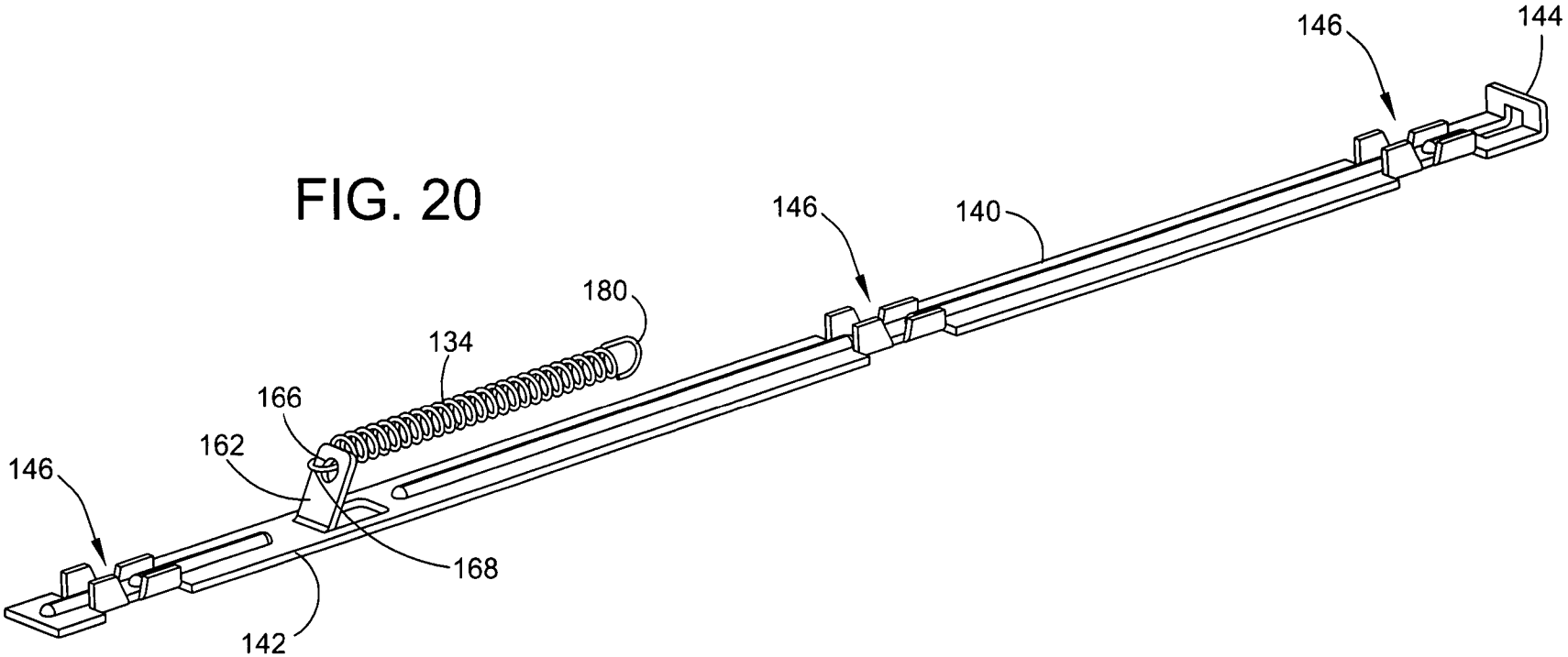
FIG. 20 is an enlarged perspective of a third version of the travel bar of the second embodiment.

A second embodiment of the ring binder mechanism of the present invention, generally indicated 130, is shown in FIGS. 15-20. This embodiment 130 is substantially similar to the first embodiment 30 except that the control structure, generally indicated 132, has been modified to accommodate a spring 134 for biasing the mechanism to the third position shown in FIG. 15 (ring members 54 closed and locked). As shown in FIGS. 17 and 18, a modified travel bar 140 is provided in the form of an elongate plate 142 having a turned up end 144 and three sets of turned up mounts, generally indicated 146. The turned up end 144 of the travel bar of the second embodiment 130 has a slot 148 for receiving the tabbed end 80 of the intermediate connector 76 that is pivotally connected to the actuating lever 68 as in the previous embodiment. The mounts 146 each pivotally attach the travel bar 140 with the connecting links 72 and function to limit the angular extent of pivotal movement of the connecting links 72 relative to the travel bar. As in the previous embodiment, each mount 146 has two opposing pairs of stops, 152 and 154 respectively, each with a respective angled surface 156, 158 for engagement by the connecting link 72. In the embodiment of FIGS. 15-18, the travel bar 140 has a tab 162 mounted on a slot or opening 164 in the elongate plate 142 with a hole 166 for receiving a first end 168 of the spring 134. As shown in FIGS. 18A through 18C, the tab 162 is attached to the travel bar 140 by stamping an end portion 170 of the tab that protrudes past the opening 164 in the elongate plate 142. FIGS. 18B and 18C show the tab 162 assembled to the travel bar having the end portion 170 deformed to have a cross-sectional area greater than the opening 164 in the elongate plate 142 preventing the tab 162 from being withdrawn from the travel bar 140. FIG. 19 shows an alternative embodiment of the travel bar 140 where the tab 162 is formed as one piece with the elongate plate 142 that is struck upwardly 90° from the surface of the plate and is generally parallel with the mounts 146. FIG. 20 shows another embodiment of the travel bar 140 where the integral tab 162 is struck upwardly less than 90° from the surface of the plate 142 so that the tab is perpendicular to the mounts 146. It will be understood that embodiments of FIGS. 19 and 20, including tabs 162 that are integral to the travel bar 140, are easier and less expensive to manufacture than the stamped tab illustrated in FIGS. 18 through 18C but the stamped tab provides a stronger connection to the travel bar.

As shown in FIGS. 15-17, the ring binder mechanism 130 is substantially similar to the previous embodiment in that the mechanism has two hinge plates 172 mounted in generally parallel arrangement and attached for pivotal motion along adjoining longitudinal edges 174 that form a hinge 176. The hinge plates 172 have an aperture 178 spaced in from the hinge 176 to receive a second end 180 of the spring 134. In the illustrated embodiment the aperture 178 is rectangular and is located on one of the hinge plates 172. Alternatively, the aperture 178 may comprise other shapes and sizes, but it will be understood that the aperture that may encompass one or both of the longitudinal edges 174 of the hinge plate 172. As shown in FIGS. 15-17, each hinge plate 172 has an inner longitudinal edge cutout 184 which cooperates with the cutout of the other hinge plate to define a cavity 186 for accommodating the body of the spring 134 and the tab 162 on the travel bar 140 that receives the first end 168 of the spring. Each hinge plate 172 has three sets of aligned notches 60 forming openings to accommodate the tabs 104 of the three connecting links 72.

In operation, the control structure 132 is configured to allow the same lengthwise movement of the travel bar 140 and the same pivotal movement of the connecting links 72 as in the previous embodiment. However, the mechanism 130 is configured to move directly from the first position (ring members 54 open) shown in FIG. 16, to the third position (ring members closed and locked) shown in FIG. 15. When an operator applies a force to the lever 68 to move the mechanism 130 from the first position where the ring members 54 are held open, the biasing force of the spring 134 advances the travel bar 140 toward the end 42 of the elongate plate 32 having the lever 68. Rather than staying in the second position where the ring members 54 are closed and unlocked, the mechanism is biased to the third position by the force of the spring 134 advancing the travel bar 140 to a location where the ring members are held closed. At this position, the clamping force of the rings 54 is maximized and any force tending to pivot the hinge plates 172 and open the ring members is firmly opposed by the locking forces of the control structure 132 resulting from the vertical orientation of the connecting links 72. Therefore, to unlock the mechanism 130, a force sufficient to oppose the spring biasing force and advance the travel bar 140 to a location corresponding with the first position of the mechanism must be applied to the actuator 68 rather than the ring members 54 so that the travel bar can pivot the connecting links 72 against the hinge plates 172 causing the ring members to open. At the first position, an external force on the actuator 68 is not required to hold the ring members 54 open because the internal forces of the control structure 132 are sufficient to overcome the force of the spring 134 to maintain the travel bar 140 at a position toward the end 42 of the elongate plate 32 not having the actuator.

Figure 21:
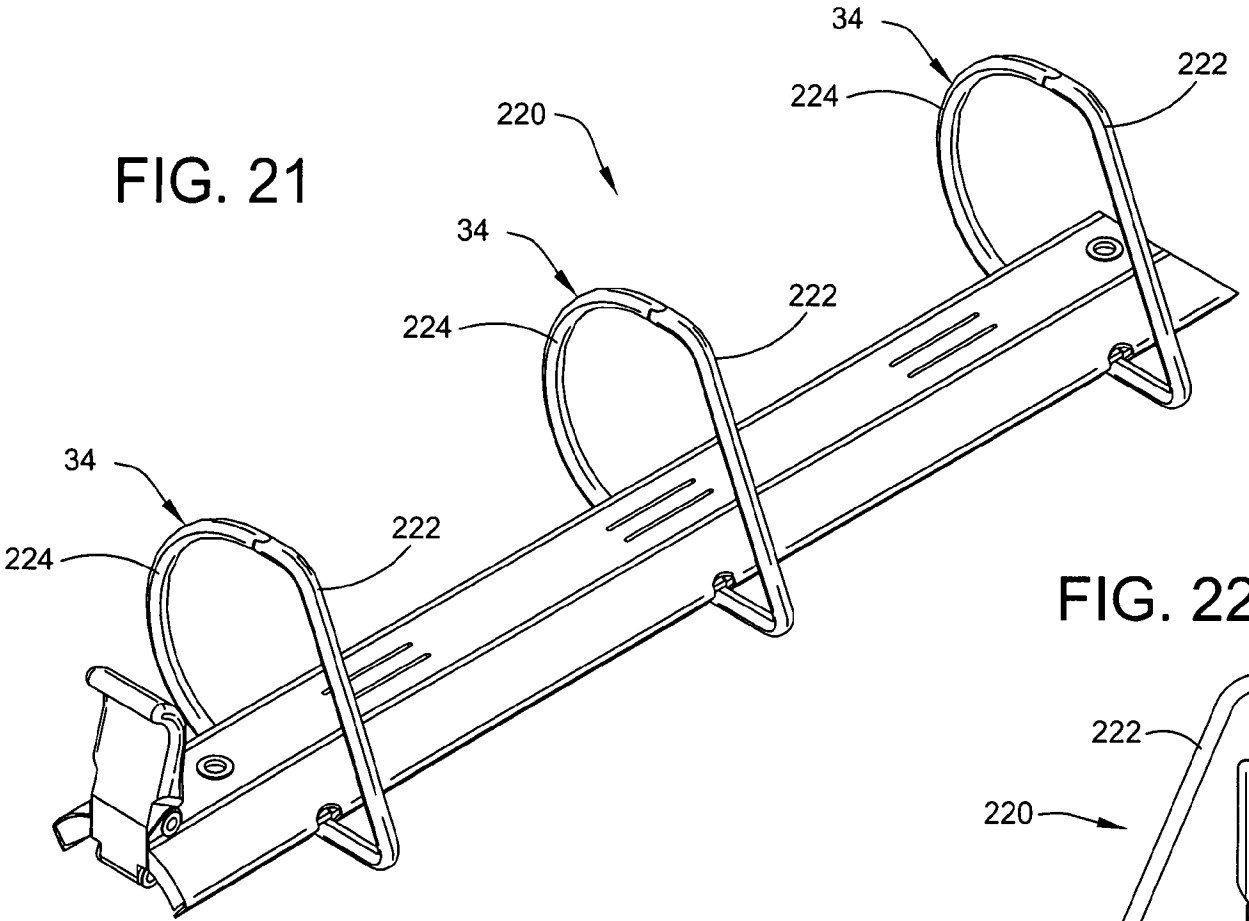
FIGS. 21 and 22 are a perspective and an end elevation, respectively, of a binder mechanism according to a third embodiment of the present invention having rings of a first slanted D shape.
Figure 22:
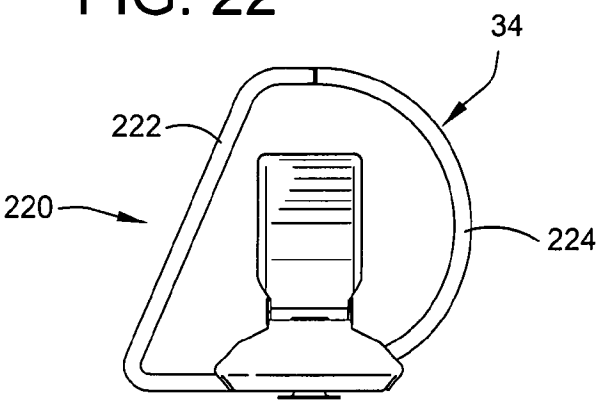

A third embodiment 220 of the present invention is shown in FIGS. 21 and 22. The rings 34 of the third embodiment have a shape generally in the form of a slanted letter D, with a first ring member 222 which is a generally straight post at an angle of inclination, and a second ring member 224 which is generally semicircular in shape.

Figure 23:
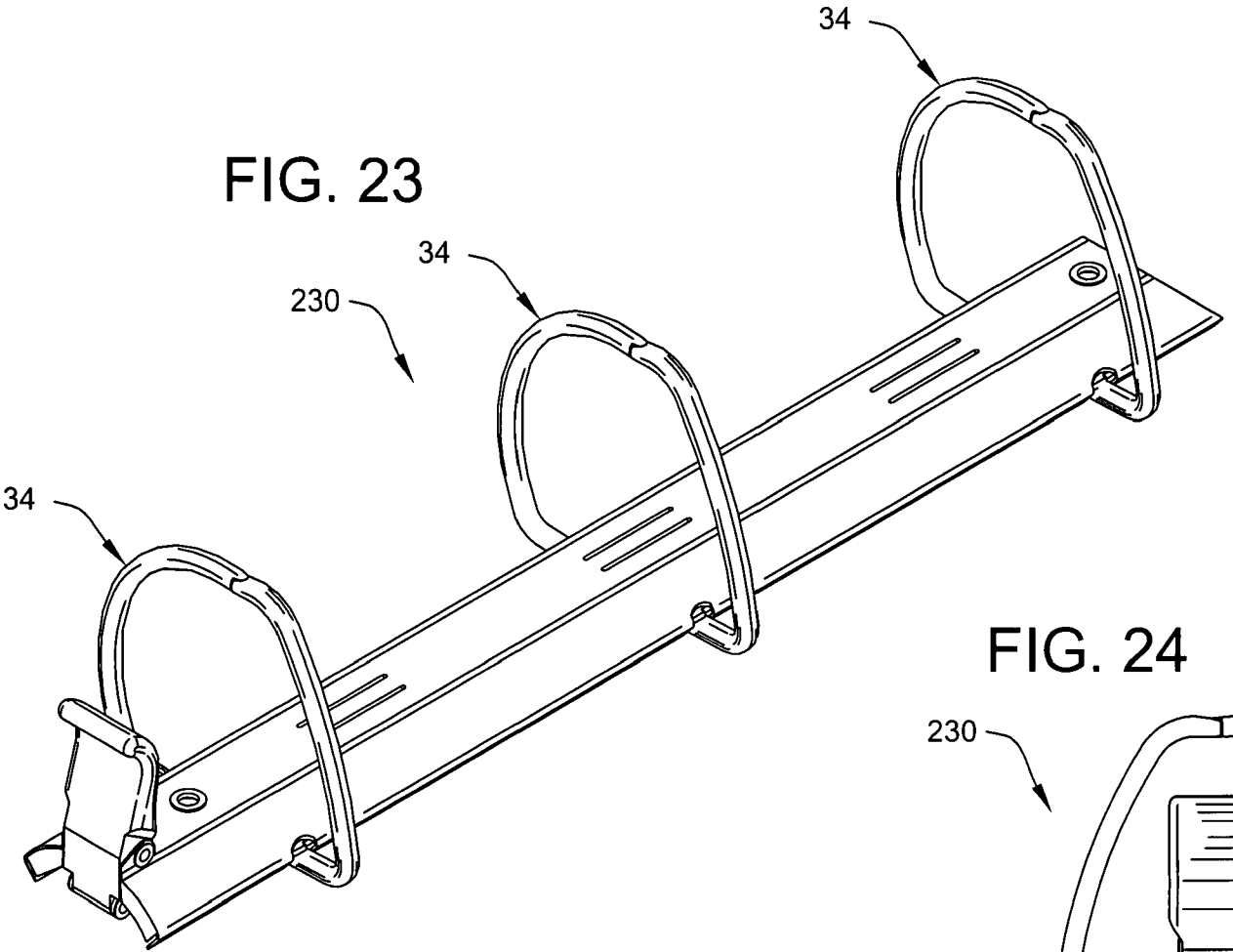
FIGS. 23 and 24 are a perspective and an end elevation, respectively, of a binder mechanism according to a fourth embodiment of the present invention having rings of a second slanted D shape.
Figure 24:
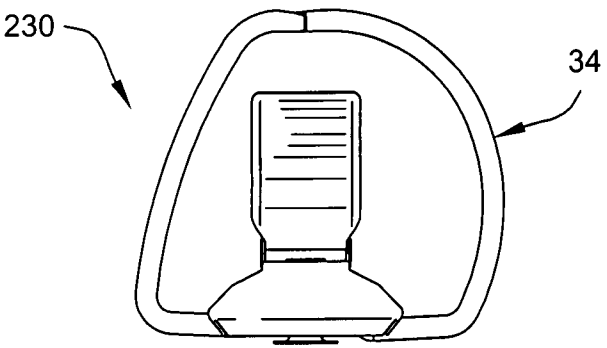

A fourth embodiment 230 of the present invention is shown in FIGS. 23 and 24. The rings 34 of the fourth embodiment have an alternate shape of another slanted D. It is understood that a mechanism having other shapes of rings does not depart from the scope of this invention. Also, the embodiments of FIGS. 22-24 could have control structures of either of the first two embodiments of the present invention.

In view of the above, it will be seen that the several objects of the invention are achieved and other advantageous results obtained.

When introducing elements of the present invention, the articles "a", "an", "the" and "said" are intended to mean that there are one or more of the elements. The terms "comprising", "including" and "having" are intended to be inclusive and mean that there may be additional elements other than the listed elements.

As various changes could be made in the above without departing from the scope of the invention, it is intended that all matter contained in the above description and shown in the accompanying drawings shall be interpreted as illustrative and not in a limiting sense.

What is claimed is:

1. A ring binder mechanism for retaining loose-leaf pages, the mechanism comprising:

an elongate plate;

hinge plates supported by the elongate plate for pivoting motion relative to the elongate plate;

rings for holding the loose-leaf pages, each ring including a first ring member and a second ring member, the first ring member being mounted on a first hinge plate and moveable with the pivoting motion of the first hinge plate relative to the second ring member between a closed position and an open position, in the closed position the two ring members forming a substantially continuous, closed loop for allowing loose-leaf pages retained by the rings to be moved along the rings from one ring member to the other, and in the open position the two ring members forming a discontinuous, open loop for adding or removing loose-leaf pages from the rings;

an actuator supported for pivoting motion by the elongate plate for actuating the ring members between the closed and open positions;

a travel bar movable generally in translation lengthwise of the elongate plate and the hinge plates;

a connector pivotally connected to the actuator and pivotally connected to the travel bar for pivoting motion relative to both the actuator and travel bar;

the connector connecting the actuator to the travel bar so that the pivoting motion of the actuator produces the translational movement of the travel bar lengthwise of the elongate plate.

2. A ring binder mechanism as set forth in claim 1 wherein the connector includes a tabbed end and the travel bar includes an end slot, the tabbed end of the connector being received in the end slot of the travel bar for permitting the relative pivoting motion between the connector and the travel bar.

3. A ring binder mechanism as set forth in claim 2 further comprising a hinge pin, the hinge pin connecting the connector to the actuator for permitting the relative pivoting motion between the connector and the actuator.

4. A ring binder mechanism as set forth in claim 1 further comprising a mounting post attached to the elongate plate, the connector transmitting force from the actuator to the travel bar around the mounting post.

5. A ring binder mechanism as set forth in claim 4 wherein the connector includes an elongate slot, the slot receiving the mounting post therethrough for allowing the connector to move relative to the mounting post.

6. A ring binder mechanism as set forth in claim 1 in combination with a cover, the ring binder mechanism being mounted on the cover, the cover being movable to selectively cover and expose loose leaf pages retained on the rings.

7. A ring binder mechanism as set forth in claim 1 wherein the connector is separate from the actuator and is separate from the travel bar.

8. A ring binder mechanism as set forth in claim 1 wherein the travel bar is positioned between the hinge plates and the elongate plate.

9. A ring binder mechanism for retaining loose-leaf pages, the mechanism comprising:

an elongate plate;

hinge plates supported by the elongate plate for pivoting motion relative to the elongate plate;

rings for holding the loose-leaf pages, each ring including a first ring member and a second ring member, the first ring member being mounted on a first hinge plate and moveable with the pivoting motion of the first hinge plate relative to the second ring member between a closed position and an open position, in the closed position the two ring members forming a substantially continuous, closed loop for allowing loose-leaf pages retained by the rings to be moved along the rings from one ring member to the other, and in the open position the two ring members forming a discontinuous, open loop for adding or removing loose-leaf pages from the rings;

an actuator supported for pivoting motion by the elongate plate for actuating the ring members between the closed and open positions;

a travel bar movable generally in translation lengthwise of the elongate plate and the hinge plates;

a connector operatively connected to the actuator and operatively connected to the travel bar for connecting the actuator to the travel bar so that the pivoting motion of the actuator produces the translational movement of the travel bar lengthwise of the elongate plate;

the connector being separate from the actuator and separate from the travel bar.

10. A ring binder mechanism as set forth in claim 9 wherein the connector includes a tabbed end and the travel bar includes an end slot, the tabbed end of the connector being received in the end slot of the travel bar for permitting the relative pivoting motion between the connector and the travel bar.

11. A ring binder mechanism as set forth in claim 10 further comprising a hinge pin, the hinge pin connecting the connector to the actuator for permitting the relative pivoting motion between the connector and the actuator.

12. A ring binder mechanism as set forth in claim 10 further comprising a mounting post attached to the elongate plate, the connector transmitting force from the actuator to the travel bar around the mounting post.

13. A ring binder mechanism as set forth in claim 12 wherein the connector includes an elongate slot, the slot receiving the mounting post therethrough for allowing the connector to move relative to the mounting post.

14. A ring binder mechanism as set forth in claim 9 in combination with a cover, the ring binder mechanism being mounted on the cover, the cover being movable to selectively cover and expose loose leaf pages retained on the rings.

15. A ring binder mechanism as set forth in claim 9 wherein the travel bar is positioned between the hinge plates and the elongate plate.

* * * * *